US008337234B2

(12) United States Patent
Sasaki et al.

(10) Patent No.: US 8,337,234 B2
(45) Date of Patent: Dec. 25, 2012

(54) LOCKING CONNECTOR AND ELECTRONIC APPARATUS

(75) Inventors: Daisuke Sasaki, Osaka (JP); Takayuki Nagata, Osaka (JP)

(73) Assignee: Hosiden Corporation, Osaka (JP)

( * ) Notice: Subject to any disclaimer, the term of this patent is extended or adjusted under 35 U.S.C. 154(b) by 25 days.

(21) Appl. No.: 13/193,451

(22) Filed: Jul. 28, 2011

(65) Prior Publication Data

US 2012/0034803 A1 Feb. 9, 2012

(30) Foreign Application Priority Data

Aug. 5, 2010 (JP) ..... 2010-176312

(51) Int. Cl.
*H01R 13/627* (2006.01)

(52) U.S. Cl. ..... 439/352; 439/357

(58) Field of Classification Search ..... 439/345, 439/350–358
See application file for complete search history.

(56) References Cited

U.S. PATENT DOCUMENTS

| | | | | |
|---|---|---|---|---|
| 4,621,885 | A | 11/1986 | Szczesny et al. | |
| 5,569,047 | A * | 10/1996 | Pauza et al. | 439/353 |
| 5,806,152 | A * | 9/1998 | Saitou et al. | 24/662 |
| 6,113,415 | A | 9/2000 | Bertsch et al. | |
| 6,257,914 | B1 * | 7/2001 | Comerci et al. | 439/357 |
| 6,585,537 | B1 * | 7/2003 | Lee | 439/358 |
| 7,081,002 | B2 * | 7/2006 | de Vanssay et al. | 439/350 |
| 7,322,845 | B2 * | 1/2008 | Regnier et al. | 439/352 |
| 7,591,664 | B2 * | 9/2009 | Nomiyama et al. | 439/352 |
| 7,901,250 | B2 * | 3/2011 | Lam et al. | 439/638 |
| 7,909,638 | B2 * | 3/2011 | Seo et al. | 439/489 |
| 2001/0003073 | A1 | 6/2001 | Endo | |

FOREIGN PATENT DOCUMENTS

| | | |
|---|---|---|
| EP | 0 512 438 | 11/1992 |
| JP | H06-010996 | 2/1994 |
| NL | 2002147 | 5/2010 |
| WO | WO 87/01871 | 3/1987 |

OTHER PUBLICATIONS

Extended European Search Report (EESR) issued on Dec. 7, 2011 by the European Patent Office for corresponding European patent application No. 11 176 614.3.

* cited by examiner

*Primary Examiner* — Thanh Tam Le
(74) *Attorney, Agent, or Firm* — David N. Lathrop

(57) ABSTRACT

A locking connector includes: a first head part; a plate-like base covering a plate surface of the first head part, a supporting part one end of which is supported by the base; first and second resilient parts positioned along the plate surface of the base from the supporting part, the first and second resilient part being resiliently deformable in a first direction substantially perpendicular to a direction C from the base end of the first head part to the fore-end of the first head part; first and second arm base end parts extending from end of the first and second resilient parts, respectively; first and second arm parts extending from the first and second arm base end parts, respectively, in the direction C; and first and second latching parts which are protrusions provided on the first and second arm parts, respectively.

20 Claims, 17 Drawing Sheets

LOCKING CONNECTOR AND ELECTRONIC APPARATUS

CROSS-REFERENCE TO RELATED APPLICATION

This application is based upon and claims priority of Japanese Patent Application No. 2010-176312, filed in Japanese Patent Office on Aug. 5, 2010, the entire contents of which are incorporated by reference herein.

TECHNICAL FIELD

The present invention relates to a connector and, in particular, to a locking connector.

BACKGROUND ART

Japanese Patent Publication No. H6-10996 (hereinafter referred to as "Patent Literature 1") discloses a locking connector that includes a housing having multiple conductive contacts, a cover, and two latch arms, which are plate springs made of a resilient metal. The latch arms are cantilever plates attached on opposite side surfaces of the cover. One ends of the latch arms are fixed to the opposite side surfaces of the cover, respectively; and hooks are formed at the other ends of the latch arm, respectively. The connector is designed to be mated to a pin header having multiple conductive pins. When the connector is mated to the pin header, the hooks of the latch arms are latched to the frame of the pin header.

In the configuration disclosed in Patent Literature 1, the latch arms resiliently deform and incline during mating of the connector to the pin header. When the connector completely mates to the pin header, the resilience of the latch arms restore the latch arms to their original shapes, whereby the hooks are latched to the frame of the pin header (see FIG. 4 of Patent Literature 1). When the latch arms in this state are pushed toward the side surface of the cover, the latch arms resiliently deform and incline, whereby the hooks of the latch arms are removed from the frame of the pin header.

It should be noted here that it is difficult to reduce the size of the conventional locking connector without significant degradation of latching reliability.

The permissible length of the latch arm increases as the length of the connector along its side in the direction from the base end to the fore-end (hereinafter referred to the "direction from the base end toward the fore-end") increases. The longer the latch arms are, the less inclined angles of the latch arms during the latching and unlatching are; the longer the latch arms are, the higher the flexibility of the latch arms is. The smaller the inclined angles of the latch arms are, the smaller the displacement of the hooks in the direction from the base end toward the fore-end is. The higher the flexibility of the latch arms is, the more easily the hooks can be aligned with the frame of the pin header. Therefore, the longer the latch arms are, the more easily the latch arm can be latched and unlatched.

On the other hand, the permissible length of the latch arm decreases as the length of the connector along the direction from the base end toward the fore-end decreases. The shorter the latch arms are, the greater inclined angles of the latch arms needed for the latching and unlatching are; the shorter the latch arms are, the lower the flexibility of the latch arm is. The greater the inclined angles of the latch arms are, the greater the displacement of the hooks in the direction from the base end toward the fore-end is. The lower the flexibility of the latch arms is, the more difficult the alignments of the hooks with respect to the frame of the pin header are. Therefore, the shorter the latch arms are, the more difficult it is for the latch arm to be latched and unlatched. In other words, the shorter the length of the connector along the direction from the base end toward the fore-end, the more difficult it is to be latched and unlatched.

Not only the locking connector disclosed in Patent Literature 1 has the problem described above. The problem is common to locking connectors in general that have a cover and arm parts that are cantilever plate springs attached on the side surfaces of the cover and in which latching parts provided in the arm parts are latched to portions of a counterpart connector.

SUMMARY OF THE INVENTION

A locking connector according to the present invention includes a first head part which is a flat connector head having a mating part formed at a fore-end; a plate-like base covering a plate surface of the first head part, the plate surface located along a direction (or a straight line) from a base end of the first head part to the fore-end of the first head part; a supporting part positioned along a plate surface of the base, one end of the supporting part being supported by the base; a first resilient part provided along the plate surface of the base, one end of the first resilient part being supported by the supporting part, the first resilient part being resiliently deformable in a first direction along the plate surface of the base, the first direction being perpendicular to the direction from the base end toward the fore-end, the other end of the first resilient part being movable along the first direction; a first arm base part extending along the base from the other end of the first resilient part to an outside of a first edge of the base, the first edge located along a first side surface of the first head part; a first arm part extending along the first side surface of the first head part from the arm base end part in the direction from the base end toward the fore-end, the first arm part being positioned apart from the base and the first head part; a first latching part formed on the first arm part, the first latching part being a protrusion protruding outwardly away from the side surface; a second resilient part positioned along the plate surface of the base, one end of the second resilient part being supported by the supporting part, the second resilient part being resiliently deformable in a second direction along the plate surface of the base, the second direction being perpendicular to the direction from the base end toward the fore-end, the other end of the second resilient part being movable along the second direction; a second arm end part extending along the base part from the other end of the second resilient part to an outside of a second edge of the base, the second edge located along a second side surface of the first head part; a second arm part extending along the second side surface of the first head part from the second arm base end part in the direction from the base end toward the fore-end, the second arm part being positioned apart from the base and the first head part; and a second latching part formed on the second arm part, the second latching part being a protrusion protruding outwardly away from the second side surface. The supporting part is positioned between the first resilient part and the second resilient part and the first head part is positioned between the first arm part and the second arm part.

According to the present invention, the size of a locking connector can be reduced without significantly degrading the latching reliability. Objects, feature and advantages of the present invention will be more apparent upon reading of the following detailed description along with the accompanying drawings.

DETAILED DESCRIPTION OF THE EMBODIMENTS

Embodiments of the present invention will be described below with reference to drawings.

First Embodiment

Figure 1:
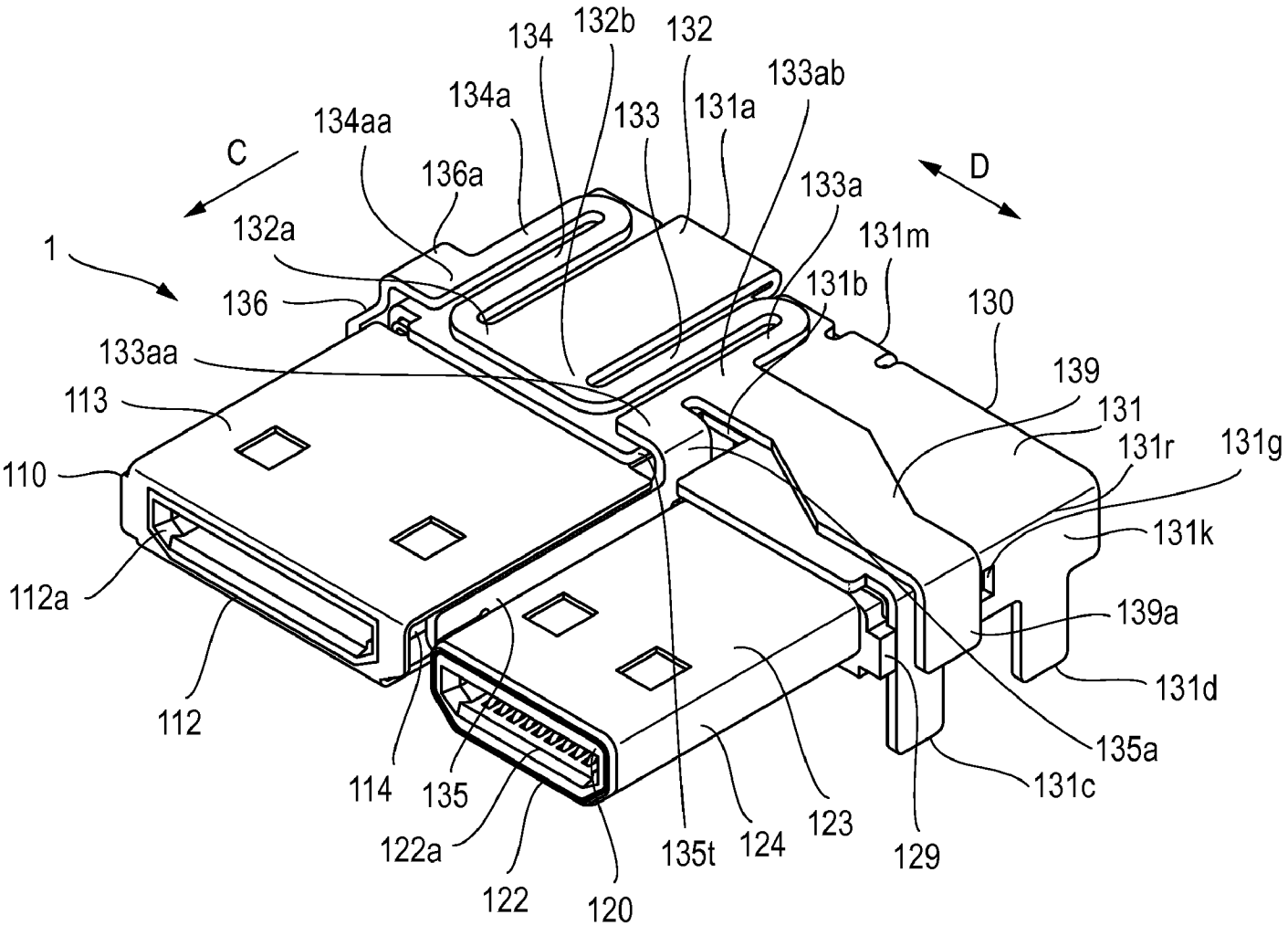
FIG. 1 is a perspective view of a locking connector of a first embodiment.
Figure 2:
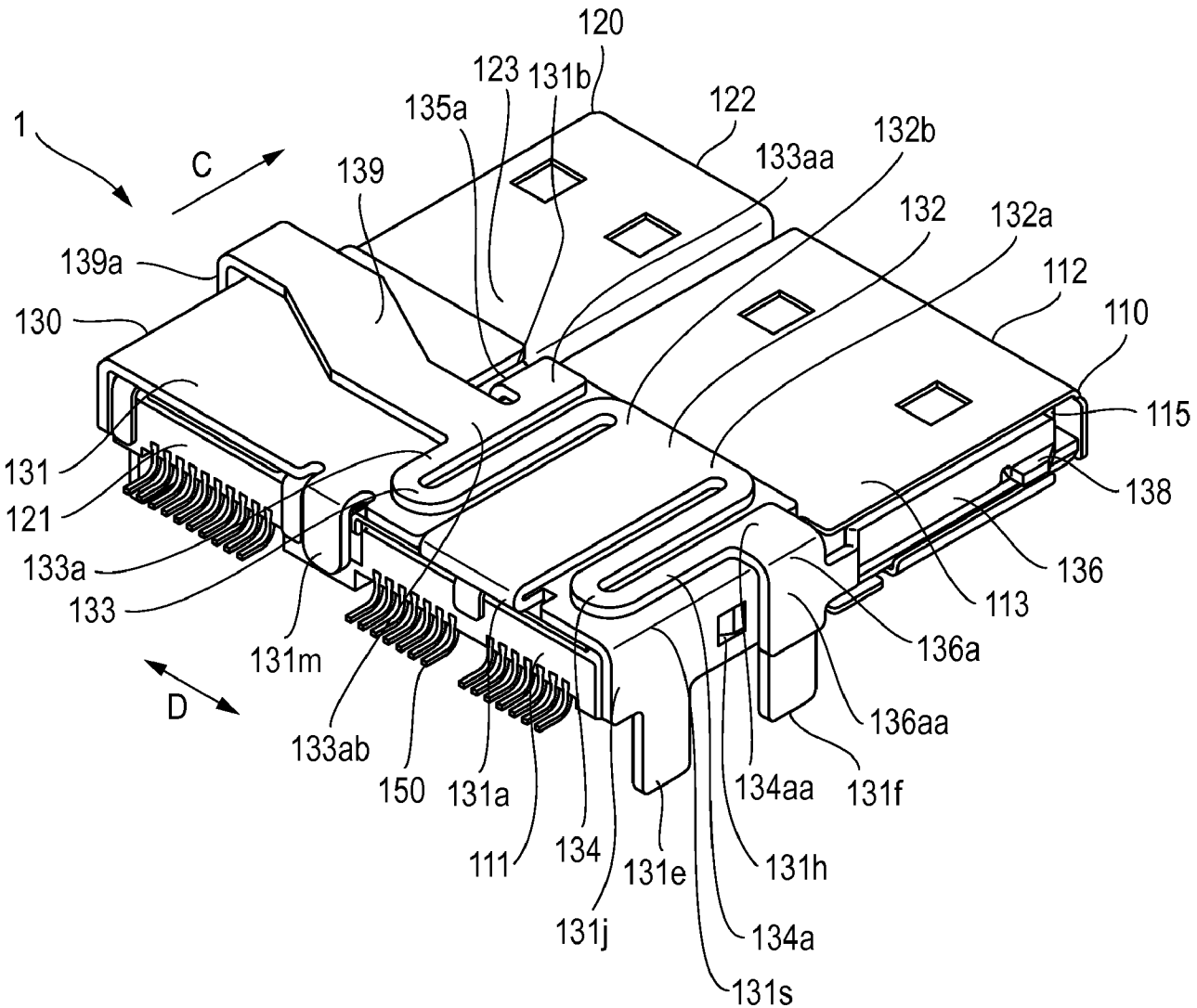
FIG. 2 is a perspective view of the locking connector of the first embodiment.

A first embodiment of the present invention will be described below. As illustrated in FIGS. 1 and 2, a locking connector of the first embodiment includes a first head part 110, a second head part 120 and a cover 130.

First Head Part 110 and Second Head Part 120

Figure 7A:
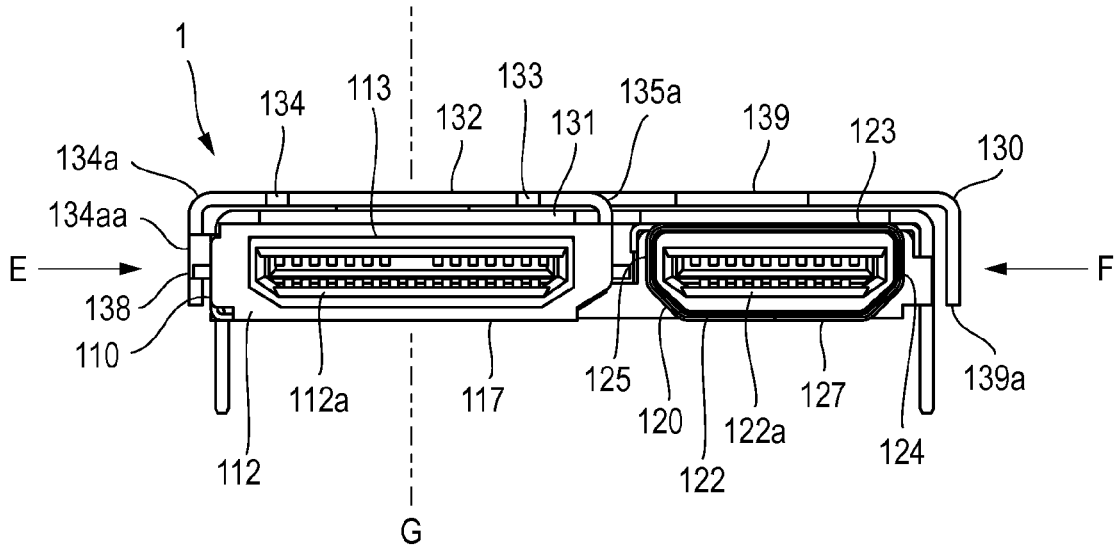
FIG. 7A is a front elevation view of the locking connector of the first embodiment.
Figure 7B:
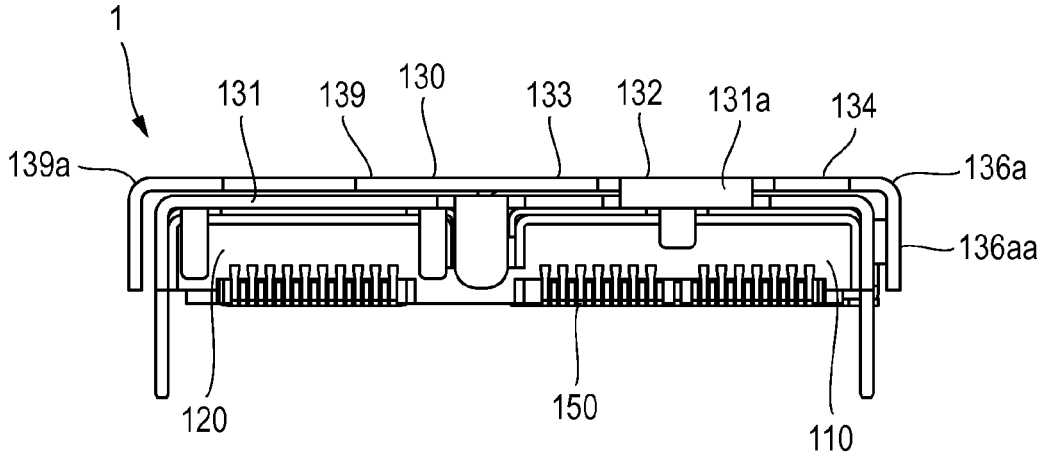
FIG. 7B is a rear elevation view of the locking connector of the first embodiment.
Figure 8A:
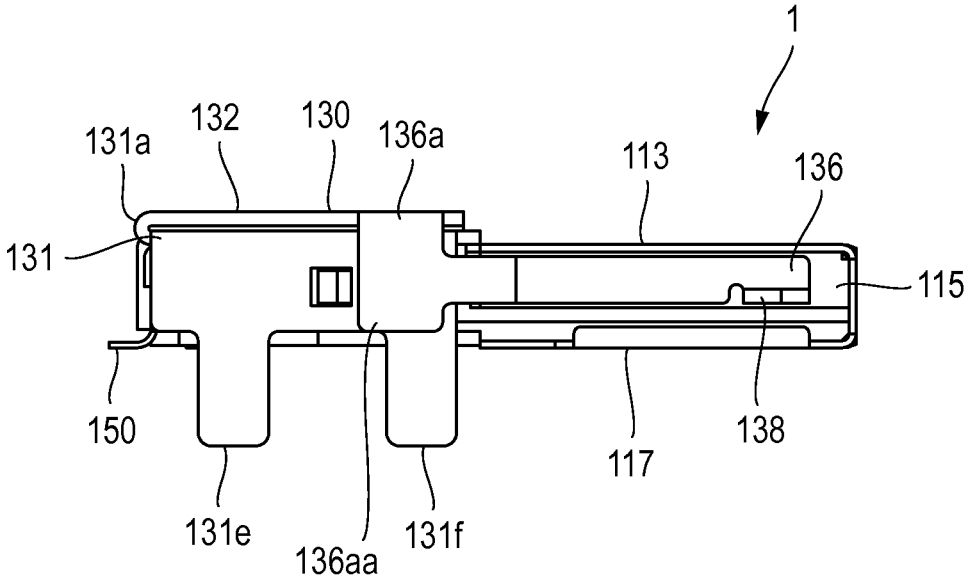
FIG. 8A is a left side view of the locking connector of the first embodiment.
Figure 8B:
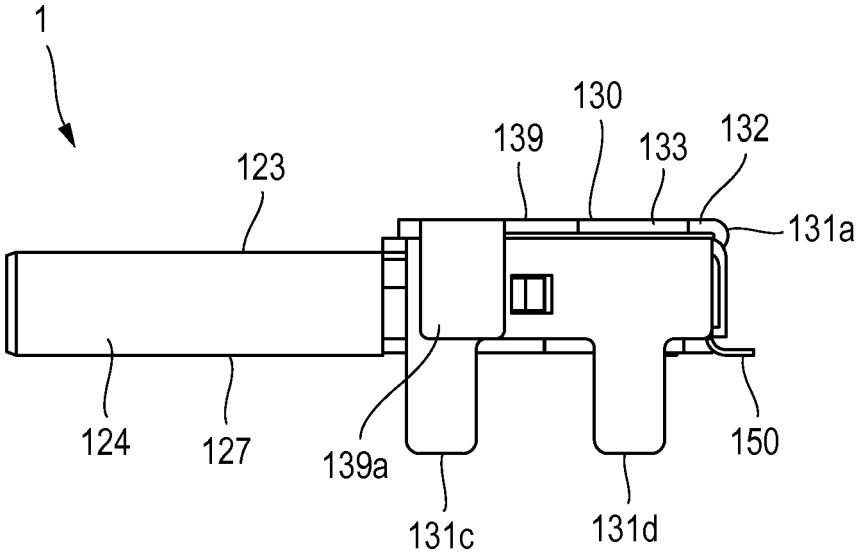
FIG. 8B is a right side view of the locking connector of the first embodiment.
Figure 9:
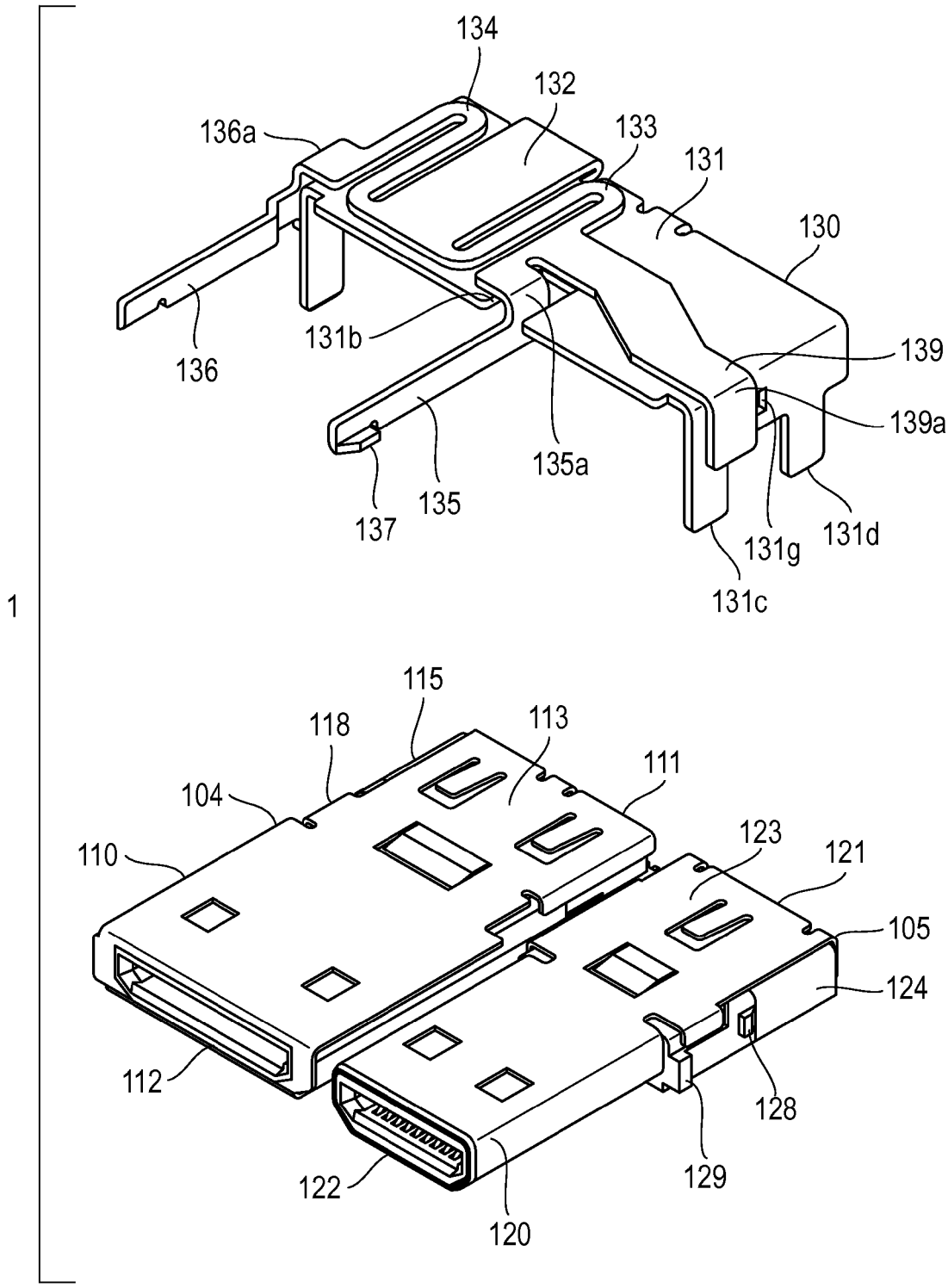
FIG. 9 is an exploded perspective view of the locking connector of the first embodiment.
Figure 10A:
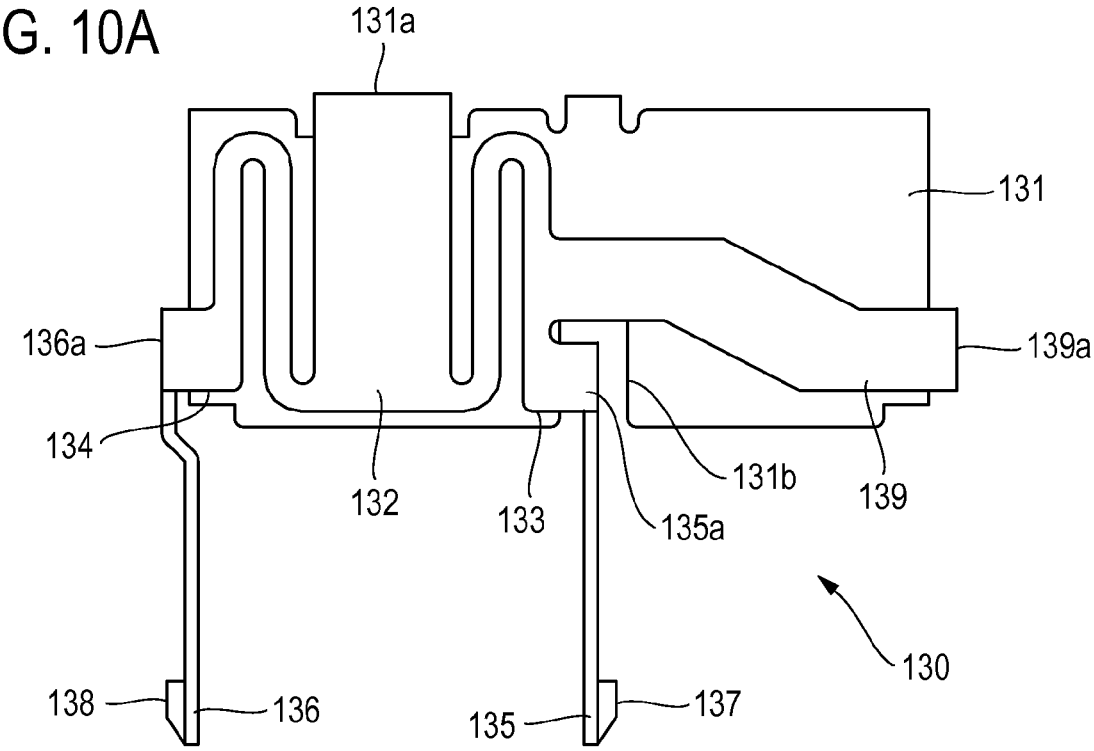
FIG. 10A is a plan view of a cover of the locking connector of the first embodiment.
Figure 10B:
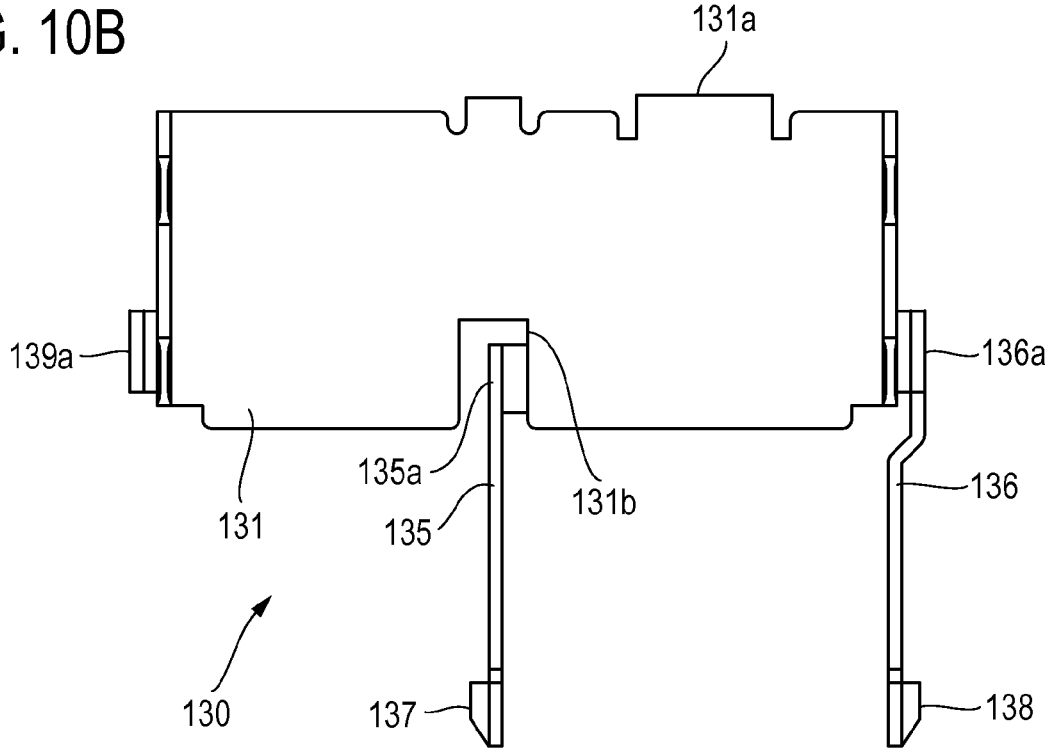
FIG. 10B is a bottom view of the cover of the locking connector of the first embodiment.
Figure 11A:
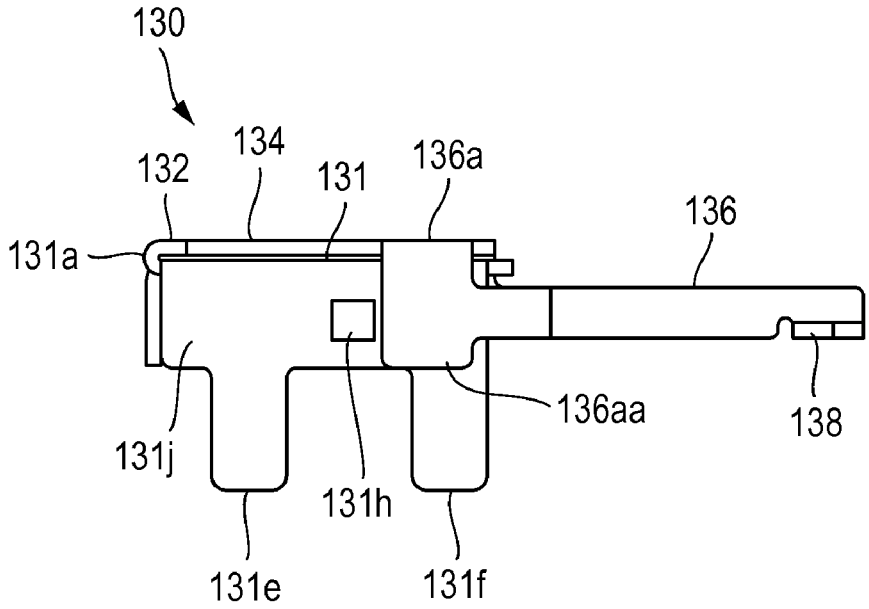
FIG. 11A is a left side view of the cover of the locking connector of the first embodiment.
Figure 11B:
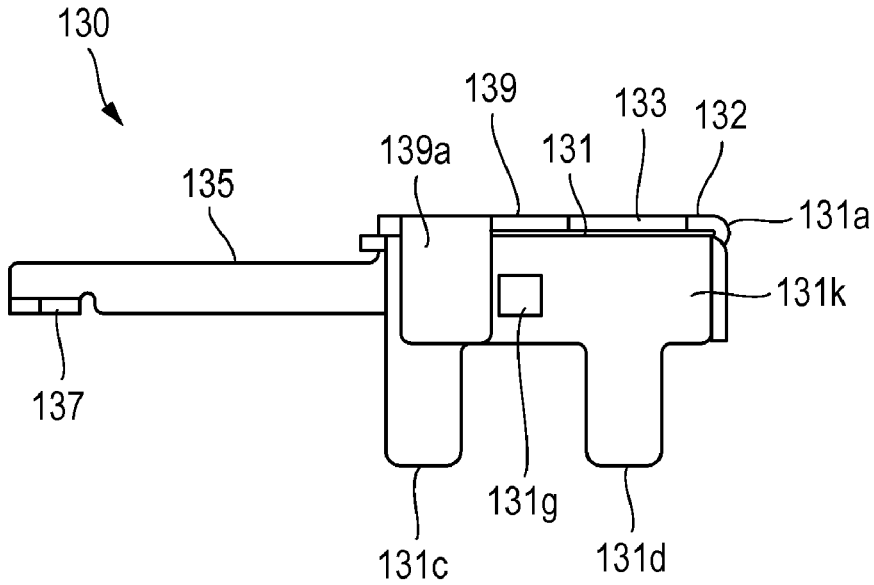
FIG. 11B is a right side view of the cover of the locking connector of the first embodiment.

The locking connector 1 of the present embodiment is a dual plug connector including the first head part 110 and the second head part 120. The first head part 110 and the second head part 120 are flat plugs. Mating parts that are matable to a counterpart connector are formed in the fore-ends 112,122 of the first head part 110 and the second head part 120, respectively. For example, each of the first head part 110 and the second head part 120 is shaped into a rectangular plate or a rectangular solid along a direction C from a base end 111, 121 toward the fore-end 112, 122, that is, the "direction C from the base end toward the fore-end". Mating holes 112*a*, 122*a* that are matable to a receptacle, which is the counterpart connector, are formed at the fore-end 112,122, respectively (see FIGS. 1 and 7A). The first head part 110 and the second head part 120 are positioned in parallel with each other and spaced apart from each other. The fore-ends 112 and 122 (mating holes 112*a* and 122*a*) face in the direction C. Top surfaces 113 and 123 (plate surfaces along the direction C) face in the direction perpendicular to the direction C. A side surface 114 (first side surface) of the first head part 110 faces a side surface 125 of the second head part 120; a side surface 115 of the first head part 110 and a side surface 124 of the second head part 120 face outward (see FIGS. 4 and 5). The top surfaces 113 and 123 in the present embodiment are the surfaces of conductive shield plates and are positioned on a plane along the direction C. Mounting surfaces 117 and 127 are positioned on a plane along the direction C, on which input/output terminals 150 provided at the base ends 111 and 121 of the first head part 110 and the second head part 120 are positioned. The top surfaces 113 and 123 are plate surfaces along the mounting surfaces 117 and 127 (see FIGS. 7A to 8B). The side surfaces 114, 115 are the opposing side surfaces, and perpendicular to the top surface 113 and the mounting surfaces 117; and the side surfaces 124, 125 are the opposing side surfaces, and perpendicular to the top surface 123 and the mounting surfaces 127. The base end 111 of the first head part 110 of the present embodiment is connected to the base end 121 of the second head part 120 (see FIGS. 2, 5, 7B and 9). Tapered latching parts 118 and 128 are provided on the side surface 115 of the first head part 110 and the side surface 124 of the second head part 120, respectively (see FIG. 9). The tapered latching parts 118 and 128 are protrusions that become gradually higher toward the fore-ends 112 and 122, respectively. A latching part 129, which is a protrusion, is provided on the side surface 124 of the second head part 120 (see FIGS. 1 and 9).

Cover 130

A cover 130 that partially covers the top surfaces 113 and 123 is fixed to the first head part 110 and the second head part 120 (see FIGS. 1 to 8B). The cover 130 of the present embodiment is a one-piece member formed from a metal plate by metalworking. The cover 130 in the present embodiment includes a base 131, side surface parts 131*j* and 131*k*, legs 131*c* to 131*f*, a supporting part 132, a first resilient part 133, a second resilient part 134, a first arm base end part 135*a*, a second arm base end part 136*a*, a first arm part 135, a second arm part 136, a first latching part 137, a second latching part 138, and extended arm part 139 (see FIGS. 1 to 11B).

The base 131 includes a plate-like part that partially covers the top surfaces 113 and 123 of the first head part 110 and the second head part 120. The base 131 in the present embodiment covers parts of the top surfaces 113 and 123 on the base end 111, 121 sides of the first head part 110 and the second head part 120 (see FIGS. 1 to 8B). A notch 131*b* is formed in a central area (an area between the first head part 110 and the second head part 120) of a front edge of the base 131 (the edge closer to the fore-ends 112 and 122) (see FIGS. 1, 2, 5, 10A and 10B).

On the side surface 115 side of the first head part 110, the plate-like side surface part 131*j* is formed from an edge 131*s* of the plate-like part of the base 131 along the side surface 115 toward the direction of the mounting surface 117. The edge 131*s* of the plate-like part of the base 131 is located along the side surface 115, between the plate-like part of the base 131 and the plate-like side surface part 131*j*. The legs 131*e* and 131*f* are extending from the end of the side surface part 131*j* on the mounting surface 117 side. The plate-like side surface part 131*k* is formed along the side surface 124 from an edge 131*r* of the plate-like part of the base 131 on the side surface 124 side of the second head part 120 toward the mounting surface 127. The edge 131*r* of the plate-like part of the base 131 is located along the side surface 124, between the plate-like part of the base 131 and the plate-like side surface part 131*k*. The plate-like legs 131*c* and 131*d* are extending from an end of the side surface part 131*k* on the mounting surface 127 side. (see FIGS. 1, 2, 5, 8A, 8B, 11A and 11B).

Rectangular through holes 131*h* and 131*g* are formed in the side surface parts 131*j* and 131*k*, respectively (see FIGS. 1, 2, 11A and 11B). When the locking connector 1 is assembled, the cover 130 slides on the first head part 110 and the second head part 120 in the direction C to partially cover the first head part 110 and the second head part 120. The leg 131*c* is supported by the latching part 129 formed on the side surface 124 of the second head part 120. The tapered latching parts 118 and 128 described above mate to the rectangular through holes 131*g* and 131*h*, respectively, to fix the cover 130 to the first head part 110 and the second head part 120. A central end part 131*m* of the base 131 that is positioned on the base ends 111, 121 side is bent toward the mounting surface 117 to firmly fix the cover 130 to the first head part 110 and the second head part 120 (see FIG. 2).

The supporting part 132 is a plate-like part positioned along the plate surface of the base 131. One end of the supporting part 132 is supported by the base 131. The base 131 in the present embodiment includes a folded part 131*a* which is an edge located on the base end 111 side of the first head part 110. The folded part 131*a* is folded in the direction C. The supporting part 132 is formed along the plate surface of the base 131 from the folded part 131*a* in the direction C (see FIGS. 1, 2, 7A to 8B, and 11A and 11B). Specifically, a metal plate is bent to form the supporting part 132 so that the plate surface of the supporting part 132 forms an angle of 180°, for example, with the plate surface of the base 131. No part of the base 131 except the folded part 131*a* is in contact with the supporting part 132. The supporting part 132 may be a cantilever plate supported by the folded part 131*a*, for example.

The first resilient part 133 is located on the second head part 120 side of the supporting part 132. The second resilient part 134 is located on the side surface 115 side of the first head part 100 of the supporting part 132 (see FIGS. 1 to 10A). That is, the supporting part 132 is positioned between the first resilient part 133 and the second resilient part 134.

The first resilient part 133 is formed along the plate surface of the base 131 from one end 132*b* of the supporting part 132 toward the second head part 120. One end of the first resilient part 133 is supported by the one end 132*b* of the supporting part 132. The first resilient part 133 is resiliently deformable along the plate surface of the base 131 in a first direction (one of directions D) perpendicular to the direction C. The other end 133*a* of the first resilient part 133 moves along the first direction (the one of directions D).

The second resilient part 134 is formed along the plate surface of the base 131 from an end part 132*a* of the supporting part 132 toward the side surface 115. One end of the second resilient part 134 is supported by the end part 132*a* of the supporting part 132. The second resilient part 134 is resiliently deformable along the plate surface of the base 131 in a second direction (the other of directions D) perpendicular to the direction C. The other end 134*a* of the second resilient part 134 moves along the second direction (the other of directions D).

As the first resilient part 133 resiliently deforms in the first direction, the other end 133*a* of the first resilient part 133 moves in the direction perpendicular to the direction C. As the second resilient part 134 resiliently deforms in the second direction, the other end 134*a* of the second resilient part 134 moves in the direction perpendicular to the direction C.

The first resilient part 133 includes a first resiliently deformable part formed into a stripe meandering along the plate surface of the base 131 from the supporting part 132 toward the side surface 114 (first side surface), for example. The second resilient part 134 includes a second resiliently deformable part formed into a stripe meandering along the plate surface of the base 131 from the supporting part 132 toward the side surface 115 (second side surface). In other words, the exemplary first and second resiliently deformable parts are serpentine strips, or serpentine springs.

For example, the first resilient part 133 may include a first resiliently deformable part formed in a U-shaped strip and the second resilient part 134 may include a second resiliently deformable part formed in a U-shaped strip. One end of the first resiliently deformable part of the first resilient part 133 may be supported by the end part 132*b* of the supporting part 132 and one end of the second resiliently deformable part of the second resilient part 134 may be supported by the end part 132*a* of the supporting part 132, for example. In other words, the exemplary first and second resiliently deformable parts are U-shaped strips, or U-shaped springs (see FIG. 1)

The first and second directions in the present embodiment are directions D along the same straight line. Accordingly, a user can apply forces to the first resilient part 133 and the second resilient part 134 in the directions along the same straight line to latch and unlatch. Therefore, a high latching reliability can be achieved (details of the operation will be described later).

In the present embodiment, the first resiliently deformable part of the first resilient part 133 resiliently deforms when pressed along the first direction; the second resiliently deformable part of the second resilient part 134 resiliently deforms when pressed along the second direction. The first and second resiliently deformable parts are symmetrical with respect to a plane G along the direction C (see FIGS. 6 and 7A). When the first and second resiliently deformable parts are symmetrical with respect to plane G, an resilient force applied to the supporting part 132 by the first resilient part 133 and an resilient force applied to the supporting part 132 by the second resilient part 134 are symmetrical with respect to the plane G and therefore the reliability of the latching structure is high. Especially when the plane G is orthogonal to the plate surface of the supporting part 132, the latching reliability is higher.

The first arm base end part 135*a* is a part extending along the base 131 from a fore-end 133*aa* of the other end 133*a* of the first resilient part 133 to the outside of the side surface 114 (first side surface) of the first head part 110. In other words, the first arm base end part 135*a* is the part extending along the base 131 from the other end 133*a* of the first resilient part 133 to the outside of the edge 135*t* of the base 131. In the present embodiment, the edge 135*t* is one of the inner edges of the notch 131*b*, and located along the side surface 114. That is, one end of the first arm base end part 135*a* is supported by the fore-end 133*aa*; the other end of the first arm base end part 135*a* is located at the outside of the side surface 114 (see FIGS. 1 to 7A and FIGS. 8A to 10A). The first arm base end part 135*a* of the present embodiment is extended, through the notch 131*b* of the base 131, to the outside of the side surface 114 of the first head part 110, is then bent toward the mounting surface 117 and then positioned along the side surface 114 (see FIGS. 1, 2 and 5). The second arm base end part 136*a* is a part extending along the base 131 from a fore-end 134*aa* which is a portion of the other end 134*a* of the second resilient part 134 to the outside of the side surface 115 (second side surface) of the first head part 110. The second arm base end part 136*a* of the present embodiment is further bent toward the mounting surface 117 and then positioned along the side surface 115. A second pressing part 136*aa* along the side surface 115 is formed at the second arm base end part 136*a*. In other words, the second arm base end part 136*a* is the part extending along the base 131 from the other end 134*a* of the second resilient part 134 to the outside of the edge 135*s* of the base 131. That is, one end of the second arm base end part 136*a* is supported by the fore-end 134*aa*; the other end of the second arm base end part 136*a* is located at the outside of the side surface 115.

Figure 3:
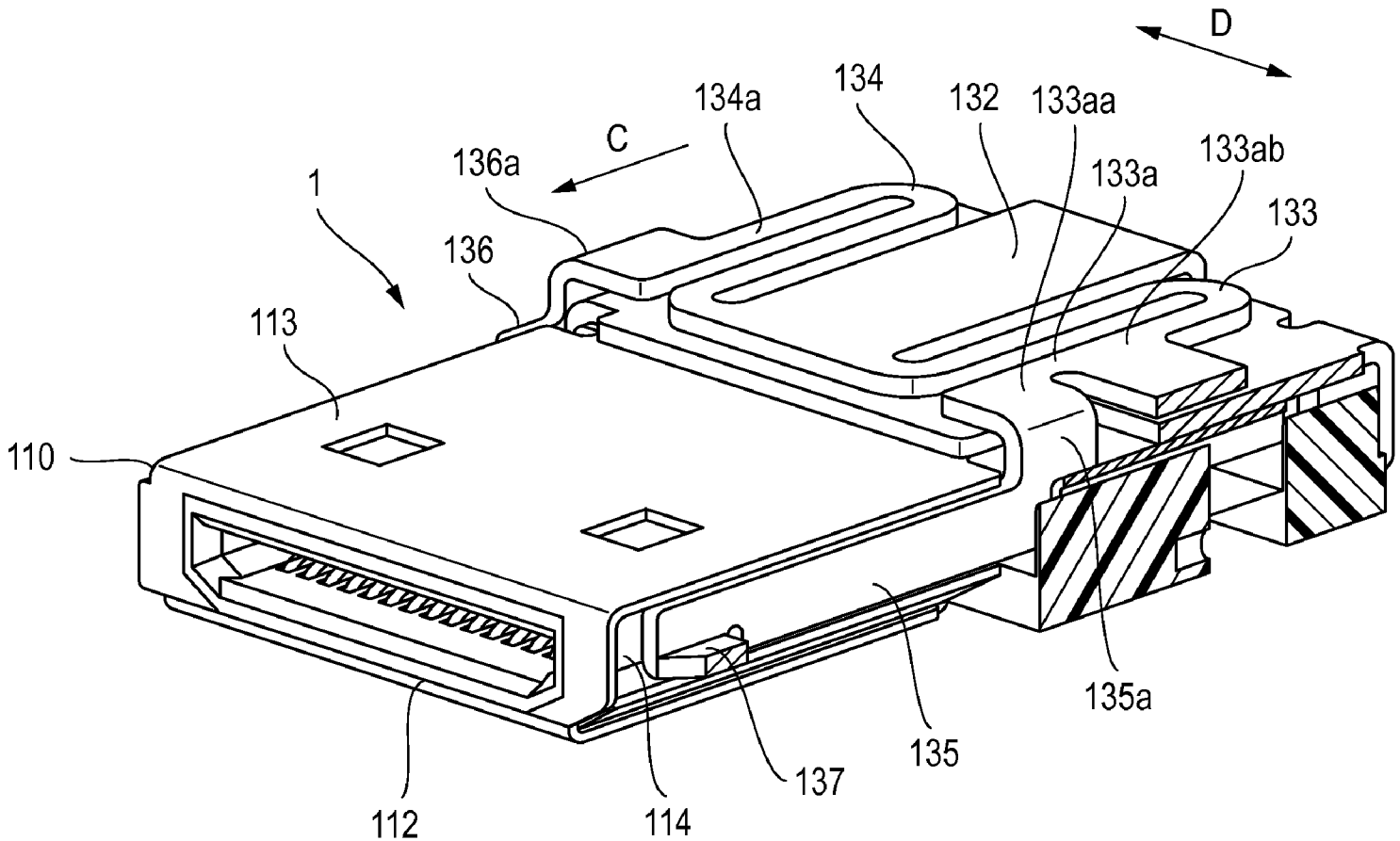
FIG. 3 is a cross-sectional perspective view of the locking connector of the first embodiment, taken along line III-III.
Figure 4:
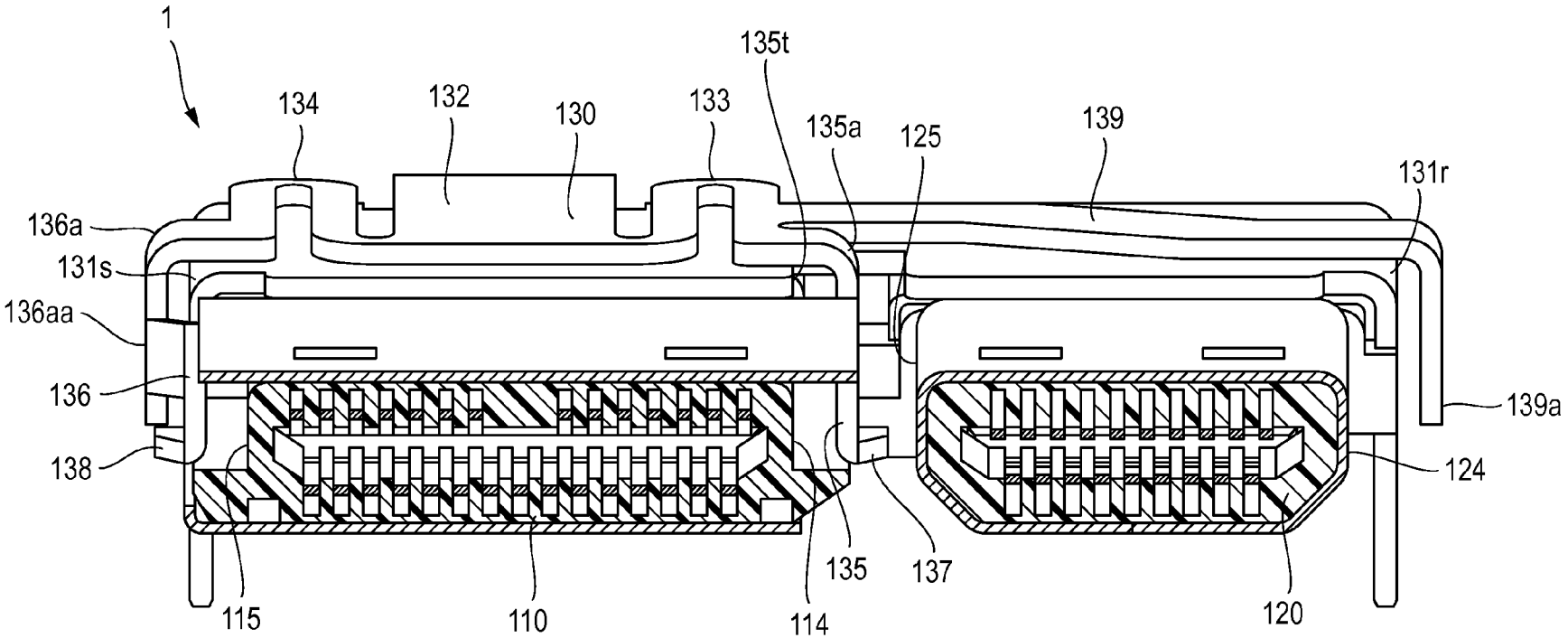
FIG. 4 is a cross-sectional perspective view of the connector of the first embodiment, taken along line IV-IV.
Figure 5:
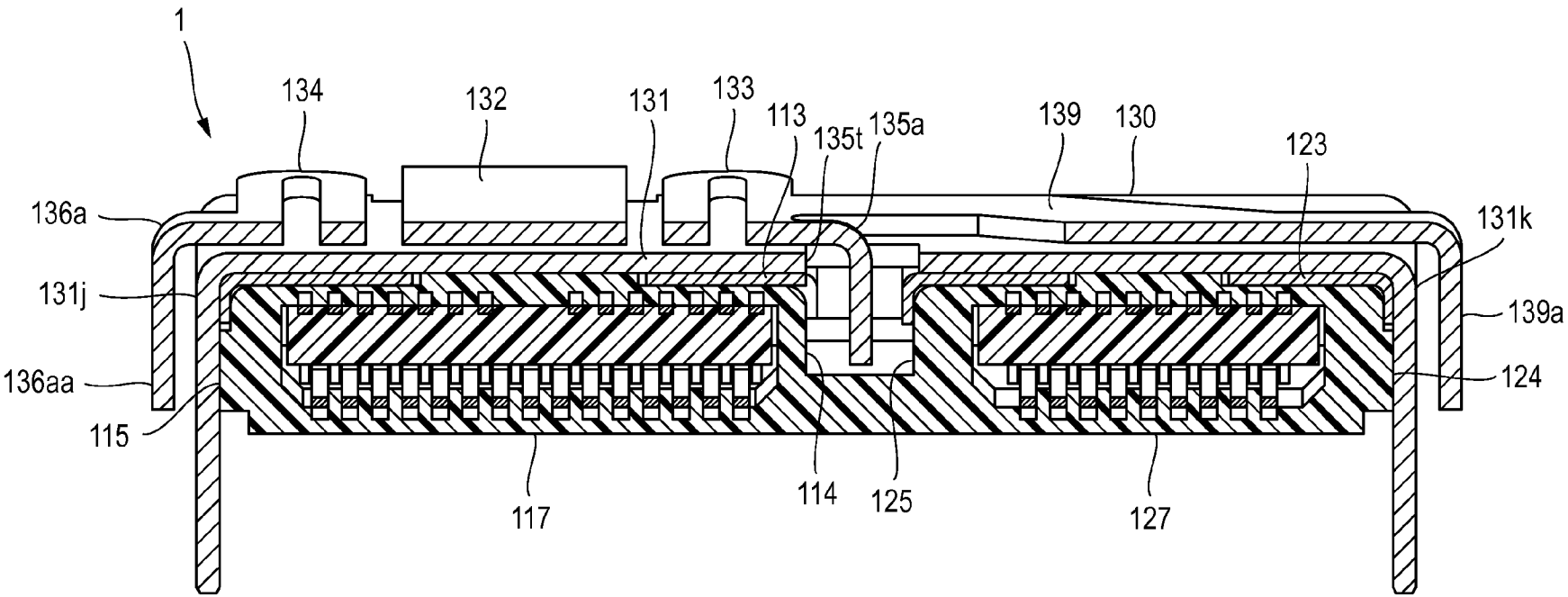
FIG. 5 is a cross-sectional perspective view of the locking connector of the first embodiment, taken along line V-V.
Figure 6:
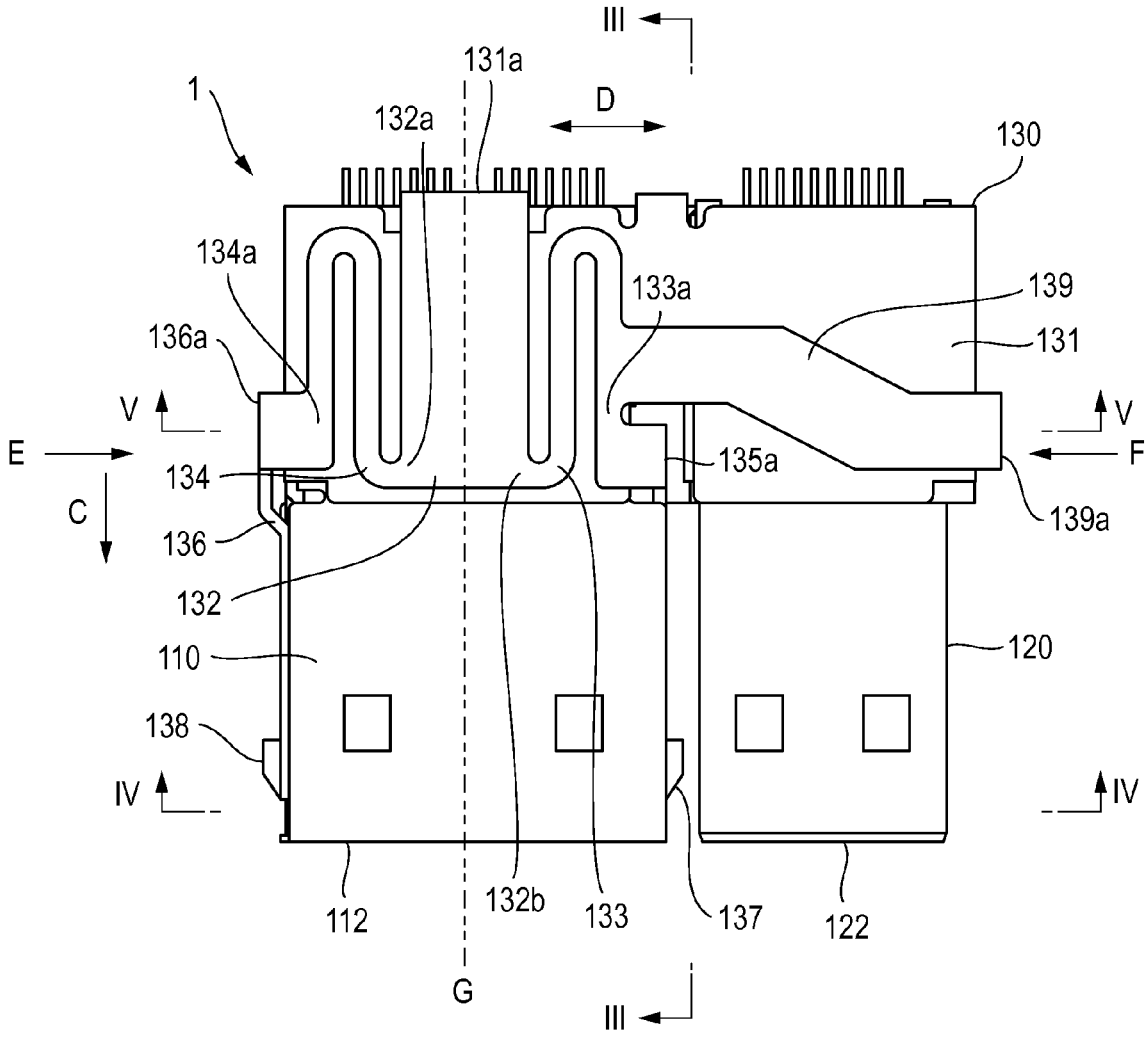
FIG. 6 is a plan view of the locking connector of the first embodiment.

The first arm part 135 is a plate extending along the side surface 114 (first side surface) of the first head part 110 from the first arm base end part 135*a* in the direction C (see FIGS. 3 and 4). That is, the first arm part 135 is a cantilever plate, one end of which is supported by the first arm base end part 135*a*; and the first arm part 135 is positioned along the side surface 114. The first arm part 135 of the present embodiment is positioned between the first head part 110 and the second head part 120. When the first resilient part 133 is not in resilient deformation, the first arm part 135 is positioned away from the base 131, the first head part 110 and the second head part 120. The second arm part 136 is a plate extending along the side surface 115 (second side surface) of the first head part 110 from the second arm base end part 136*a* in the direction C (see FIGS. 3 and 4). That is, the second arm part 136 is a cantilever plate, one end of which is supported by the second arm base end part 136*a*; and the second arm part 136 is positioned along the side surface 115. The first head part 110 is positioned between the first arm part 135 and the second arm part 136. When the second resilient part 134 is not in resilient deformation, the second arm part 136 is positioned away from the base 131 and the first head part 110.

The first latching part 137 protruding outwardly away from the side surface 114 (first side surface) is formed at the fore-end, in the direction C, of the first arm part 135. For example, the fore-end of the first arm part 135 is bent outwardly to form the first latching part 137. The first latching part 137 is positioned away from the second head part 120. The second latching part 138 protruding outwardly away from the side surface 115 (second side surface) is formed at the fore-end, in the direction C, of the second arm part 136. For example, the fore-end of the second arm part 136 is bent outwardly to form the second latching part 138.

The extended arm part 139 is a strip-like part extending along the top surface of the second head part 120 (along the base 131) from the central part 133*ab* of the other end 133*a* of the first resilient part 133 to the outside of the side surface 124 of the second head part 120. That is, the extended arm part 139 is a cantilever arm, one end of which is supported by the other end 133*a* of the first resilient part 133; and the extended arm part 139 is positioned along the base 131 and the other end of the extended arm part 139 is located out of the edge 131*r*. The fore-end of the extended arm part 139 is positioned outside of the side surface 124 of the second head part 120 (see FIGS. 1 to 7B and FIGS. 8B to 10A). A plate-like first pressing part 139*a* extending along the side surface 124 toward the mounting surface 127 is provided in a portion (for example the fore-end) of the extended arm part 139 positioned outside the side surface 124 of the second head part 120. The first pressing part 139*a* and the second pressing part 136*aa* of the present embodiment are positioned on a plane perpendicular to the direction C. In other words, the first pressing part 139*a* and the second pressing part 136*aa* of the present embodiment intersect with a plane facing the direction C (see FIGS. 5 and 6). When the first pressing part 139*a* and the second pressing part 136*aa* are pressed along directions D, collinear forces are exerted on the first resilient part 133 and the second resilient part 134.

When the first resilient part 133 and the second resilient part 134 are not in resilient deformation, the first arm base end part 135*a*, the second arm base end part 136*a*, the second pressing part 136*aa*, the first arm part 135, the second arm part 136, the extended arm part 139, and the first pressing part 139*a* are not in contact with the base 131, the legs 131*c* to 131*f* or other portions of the cover 130, the first head part 110 or the second head part 120.

Mounting

Figure 14:
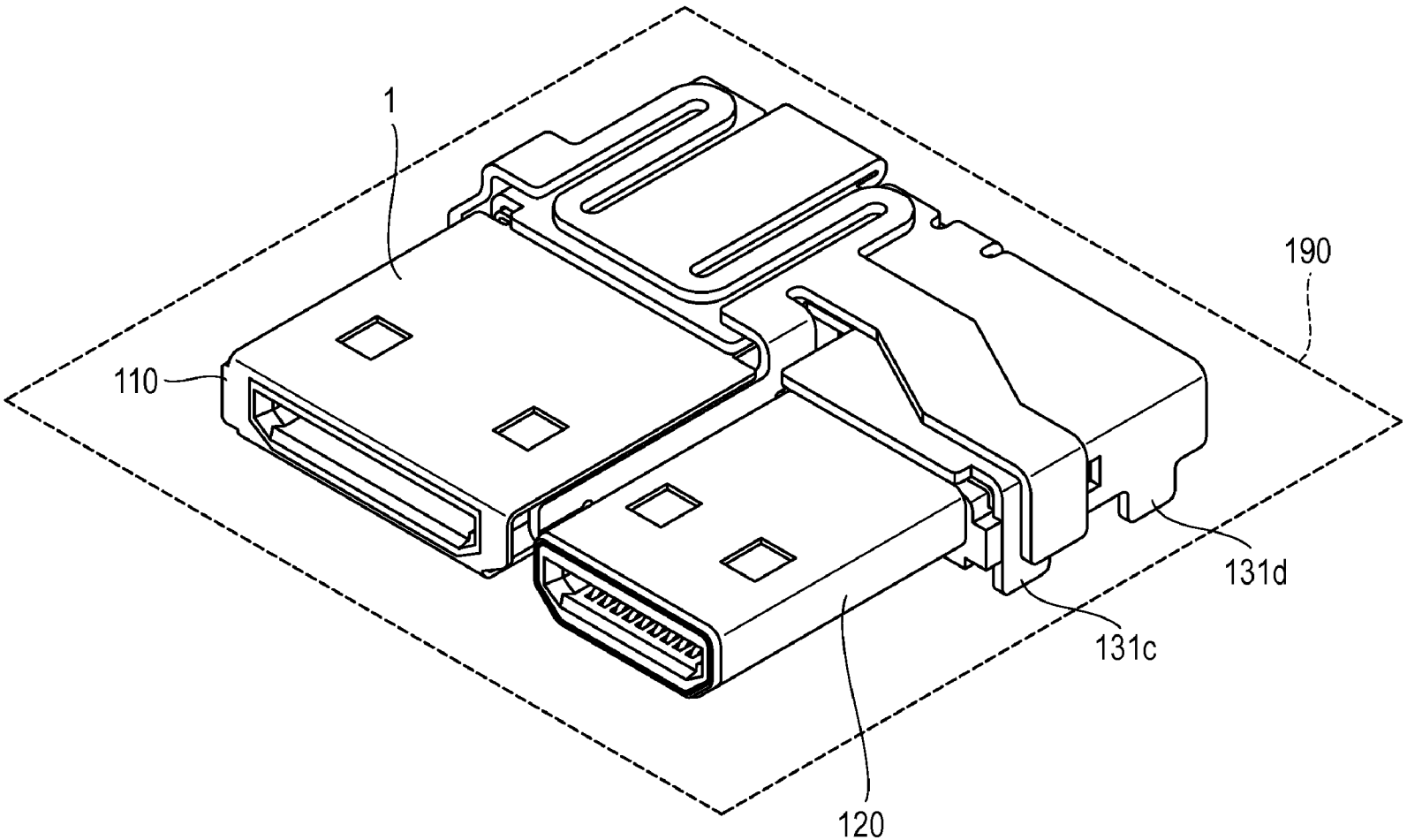
FIG. 14 is a diagram illustrating a mounted locking connector of the first embodiment.

As illustrate in FIG. 14, the locking connector 1 of the present embodiment is mounted on a surface of a mounting board 190. The legs 131*c* to 131*f* of the first head part 110 and the second head part 120 are inserted into insertion holds in the mounting board 190 and are soldered; the mounting surfaces 117 and 127 and the input/output terminals 150 are positioned on the mounting board 190 and the input/output terminals 150 are soldered to a pattern on the mounting board 190 (see FIGS. 7A, 7B and 14). An example of the mounting board 190 is a circuit board in an electronic apparatus. The electronic apparatus includes a locking connector 1 designed to be connected to another electronic apparatus including a receptacle.

Operation of Cover 130

Figure 12:
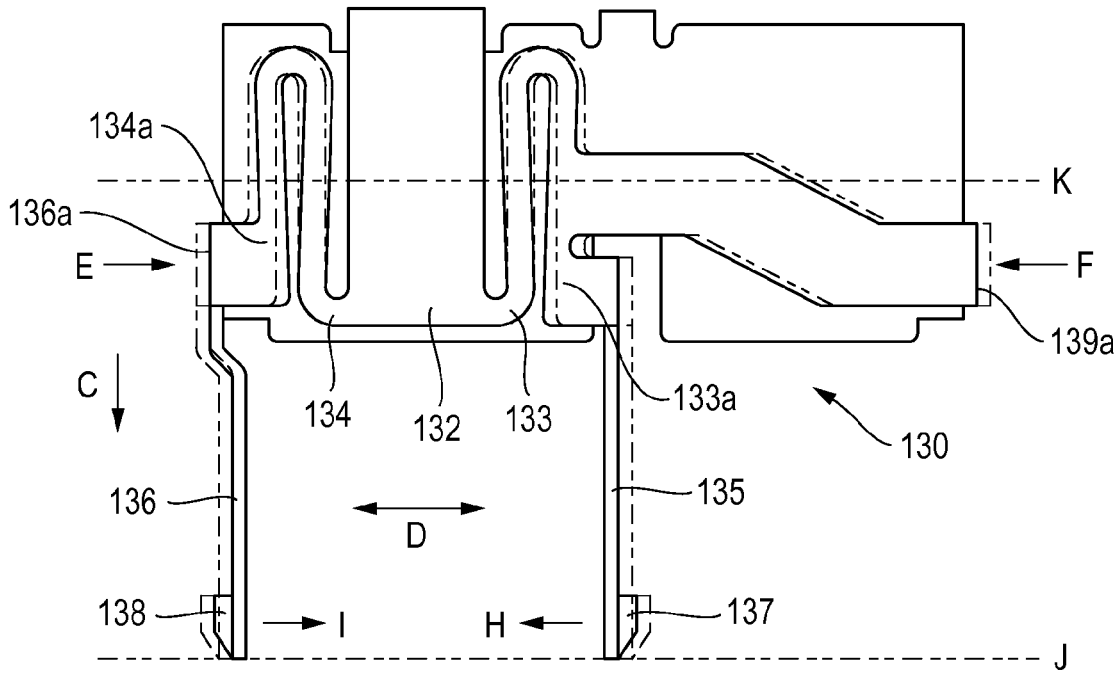
FIG. 12 is a diagram illustrating movement of the cover of the locking connector of the first embodiment.
Figure 13A:
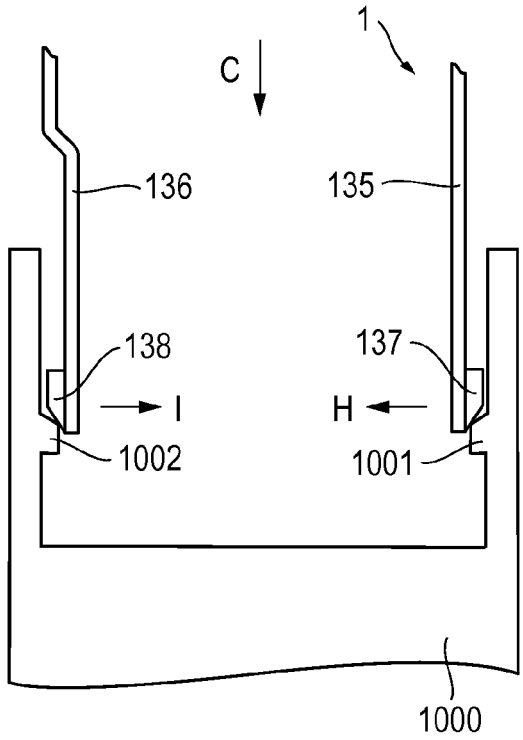
FIGS. 13A to 13D are schematic diagrams illustrating latching and unlatching of the locking connector of the first embodiment.
Figure 13B:
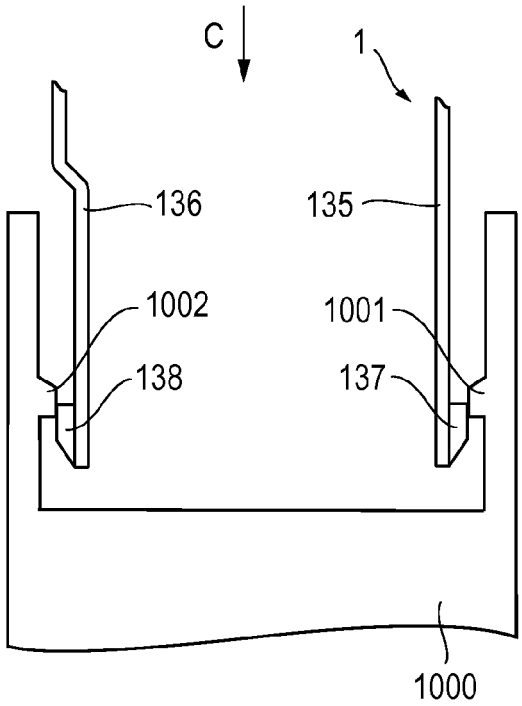
Figure 13C:
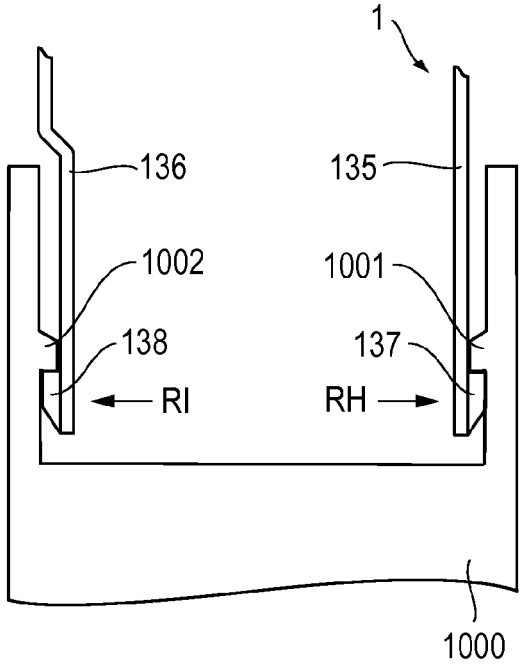
Figure 13D:
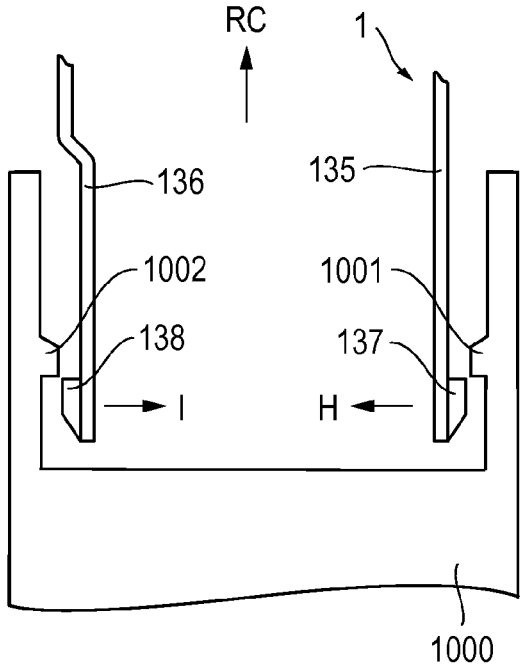

The cover 130 attached to the first head part 110 and the second head part 120 includes a lock mechanism that is latched to the receptacle, which is a counterpart connector. Referring to FIG. 12, an operation of the lock mechanism of the cover 130 will be described below. For the sake of clarity of the operation of the cover 130, only the cover 130 is depicted in FIG. 12. The cover 130 in reality is fixed to the first head part 110 and the second head part 120 as described above.

When the first pressing part 139*a* and the second pressing part 136*aa* are not pushed, the first resilient part 133 and the second resilient part 134 are not in resilient deformation but are in ordinary positions (see chain double-dashed lines in FIG. 12). As the first latching part 137 of the first arm part 135 and the second latching part 138 of the second arm part 136 are latched to two third latching parts (recesses or protrusions) formed in both side surfaces of the counterpart connector, the first latching part 137 of the first arm part 135 and the second latching part 138 of the second arm part 136 move closer to each other (in directions H and I, respectively) (see solid arrows in FIG. 12).

For example, the first pressing part 139*a* is pressed toward the center of the cover 130 in a direction F perpendicular to the direction C, the second pressing part 136*aa* is pressed toward the center of the cover 130 in a direction E perpendicular to the direction C, and the first latching part 137 and the second latching part 138 move closer to each other (directions H and I, respectively). More specifically, when the first pressing part 139*a* is pressed in the direction F and the second pressing part 136*aa* is pressed in the direction E, the first resilient part 133 and the second resilient part 134 resiliently retract in the directions D perpendicular to the direction C, the other end 133*a* of the first resilient part 133 and the other end 134*a* of the second resilient part 134 move in the directions perpendicular to the direction C, the first latching part 137 of the first arm part 135 moves in the direction H, and the second latching part 138 of the second arm part 136 moves in the direction I. When subsequently the first pressing part 139*a* and the second pressing part 136*aa* are released, the first latching part 137 moves in the direction opposite to the direction H, the second latching part 138 moves in the direction opposite to the direction I, and the first latching part 137 and the second latching part 138 are latched to the two respective latching parts (latching A).

Alternatively, when the first latching part 137 and the second latching part 138 are pressed by the peripheries of the third latching parts which are protrusions or recesses, the first latching part 137 and the second latching part 138 move closer to each other (in directions H and I, respectively). More specifically, when the first latching part 137 and the second latching part 138 are pressed by the peripheries of the third latching parts which are protrusions or recesses, the first resilient part 133 and the second resilient part 134 resiliently retract in the directions D perpendicular to the direction C, the first latching part 137 of the first arm part 135 moves in the direction H, and the second latching part 138 of the second arm part 136 moves in the direction I. Then the first latching part 137 moves in the direction opposite to the direction H, the second latching part 138 moves in the direction opposite to the direction I, and the first latching part 137 and the second latching part 138 are latched to the two respective third latching parts (latching B).

In either case, the first resilient part 133 and the second resilient part 134 resiliently retract in the directions D perpendicular to the direction C. Accordingly, the first latching part 137 and the second latching part 138 move along a plane J perpendicular to the direction C and the displacements of the first latching part 137 and the second latching part 138 in the direction C are small. This avoids the problem that the first latching part 137 and the second latching part 138 are significantly displaced in the direction C to fail to be latched properly to the third latching parts of the counterpart connector.

When first pressing part 139*a* is pressed in the direction F and the second pressing part 136*aa* is pressed in the direction E while the first and second latching parts 137 and 138 are latched, the first resilient part 133 and the second resilient part 134 resiliently retract in the directions D perpendicular to the direction C (see the solid arrow in FIG. 12). With the retraction, the other end 133*a* of the first resilient part 133 and the other end 134*a* of the second resilient part 134 move in the directions perpendicular to the direction C and the first latching part 137 of the first arm part 135 and the second latching part 138 of the second arm part 136 move closer to each other (in the directions H and I, respectively). As a result of the movements, the first latching part 137 and the second latching part 138 are released from the third latching parts of the counterpart connector and unlatched. The first resilient part 133 and the second resilient part 134 resiliently retract in the directions D perpendicular to the direction C. As a result, the first latching part 137 and the second latching part 138 move along the plane J perpendicular to the direction C and the displacements of the first latching part 137 and the second latching part 138 in the direction C are small. This avoids the problem that the first latching part 137 and the second latching part 138 are significantly displaced in the direction C and caught in certain positions in the counterpart connector to fail to be unlatched.

Referring to FIGS. 13A to 13D, latching B and unlatching will be illustrated below.

A counterpart connector 1000 schematically illustrated in FIGS. 13A to 13D includes third latching parts 1001 and 1002 which are two opposed protrusions. When the locking connector 1 is moved in the direction C for mating with the counterpart connector 1000, the first latching part 137 of the first arm part 135 and the second latching part 138 of the second arm part 136 come into contact with the third latching parts 1001 and 1002, respectively (see FIG. 13A). As the locking connector 1 is further moved in the direction C, the first latching part 137 and the second latching part 138 are pressed by the third latching parts 1001 and 1002, respectively, and the first latching part 137 of the first arm part 135 moves in the direction H and the second latching part 138 of the second arm part 136 moves in the direction I (see FIG. 13B). As the locking connector 1 is further moved in the direction C, the first latching part 137 moves in the direction RH opposite to the direction H, the second latching part 138 moves in the direction RI opposite to the direction I, and the first latching part 137 and the second latching part 138 are latched to the two third latching parts 1001 and 1002, respectively (see FIG. 13C).

When the first pressing part 139*a* is pressed in the direction F and the second pressing part 136*aa* is pressed in the direction E (see the solid arrows in FIG. 12) while the first and second latching parts 137 and 138 are latched, the first latching part 137 moves in the direction H, the second latching part 138 moves in the direction I, and the first latching part 137 and the second latching part 138 are released from the third latching parts 1001 and 1002, respectively, and unlatched. When unlatched, the locking connector 1 can be pulled out from the counterpart connector 1000 in direction RC opposite to the direction C (see FIG. 13D).

Features of the First Embodiment

Since the first resilient part 133 and the second resilient part 134 of the locking connector 1 of the present embodiment resiliently retract in the first directions (directions D) and the first latching part 137 and the second latching part 138 move along the plane J perpendicular to the direction C (see FIG. 12) as described above, the displacements of the first latching part 137 and the second latching part 138 in the direction C are small. This prevents the first latching part 137 or the second latching part 138 from being caught in an improper position in the counterpart connector. Therefore the locking connector 1 has a high latching reliability. The reliability does not significantly degrade even if the length of the locking connector 1 along the direction C is reduced. Furthermore, the flexibility of the first resilient part 133 and the second resilient part 134 does not significantly decrease even if the length of the locking connector 1 along the direction C is reduced. Therefore, the size of locking connector 1 can be reduced without significant degradation of the latching reliability.

As both of the first resilient part 133 and the second resilient part 134 resiliently retract along the directions D, the first latching part 137 and the second latching part 138 move along the directions D. Therefore, if the counterpart connector is displaced in the directions D with respect to the locking connector 1, the latching reliability does not significantly degrade.

When the first pressing part 139*a* and the second pressing part 136*aa* intersect with the plane facing the direction C, the force exerted on the first pressing part 139*a* and the force exerted on the second pressing part 136*aa* are in the directions along that plane. Therefore, the locking connector 1 is easy to handle and has a high latching reliability.

When the first resilient part 133 and the second resilient part 134 are symmetrical with respect to plane G (plane parallel to the direction C and orthogonal to the supporting part 132), the resilient force of the first resilient part 133 and the resilient force of the second resilient part 134 exerted on the supporting part 132 are symmetrical to each other and also the amounts of displacement of the first latching part 137 and the second latching part 138 with respect to the supporting part 132 are symmetrical. The locking connector 1 having such first resilient part 133 and second resilient part 134 is easy to handle and has a high latching reliability.

While the locking connector 1 of the present embodiment includes the first head part 110 and the second head part 120, the lock mechanism is provided only on the first head part 110. Accordingly, the configuration of the locking connector 1 of the present embodiment can also be used for a dual plug connector including a connector head in which the lock mechanism can be provided and a connector head in which the lock mechanism cannot be provided (a connector head conforming to a standard such as HDMI (High-Definition Multimedia Interface)).

The locking connector 1 of the present embodiment includes the extended arm part 139 and the first pressing part 139*a* is formed at the fore-end of the extended arm part 139. Accordingly, the first pressing part 139*a* included in the lock mechanism provided in the first head part 110 can be positioned near the side surface 124 of the second head part 120 in which no lock mechanism is provided.

Since the base 131 includes the plate-like part that partially covers the top surfaces 113 and 123 of the first head part 110 and the second head part 120 and the first resilient part 133 and the second resilient part 134 are formed into a plate-like along the plate-like part of the base 131, the locking connector 1 is reduced in size and height. Since the base 131, the supporting part 132, the first and second resilient parts 133 and 134, the first and second arm base end parts 135*a* and 136*a*, the first and second arm parts 135 and 136, and the first and second latching parts 137 and 138 are one integral structure and the lock mechanism is included in the cover 130, the number of discrete components are small.

When the first resilient part 133 and the second resilient part 134 are not in resilient deformation, the supporting part 132, the first and second resilient parts 133 and 134, the first and second arm base end parts 135*a* and 136*a*, the first and second arm parts 135 and 136, and the first and second latching parts 137 and 138 are not in contact with base 131, except the folded part 131*a*. Accordingly, no friction is produced between the base 131 and these members which would prevent movement of the first and second arm parts 135 and 136 or would exert a counterforce in an unintended direction on the first and second arm parts 135 and 136. Accordingly, a high latching reliability is achieved.

The terms "perpendicular", "parallel", "same", "rectangular plate", "rectangular solid", "180°", "U-shaped" and "symmetrical" as used in the foregoing description mean "substantially perpendicular", "substantially parallel", "substantially the same", "substantially rectangular plate", "substantially rectangular solid", "substantially 180°", "substantially U-shaped", and "substantially symmetrical" without departing from the spirit and scope of the present invention.

Second Embodiment

Figure 15:
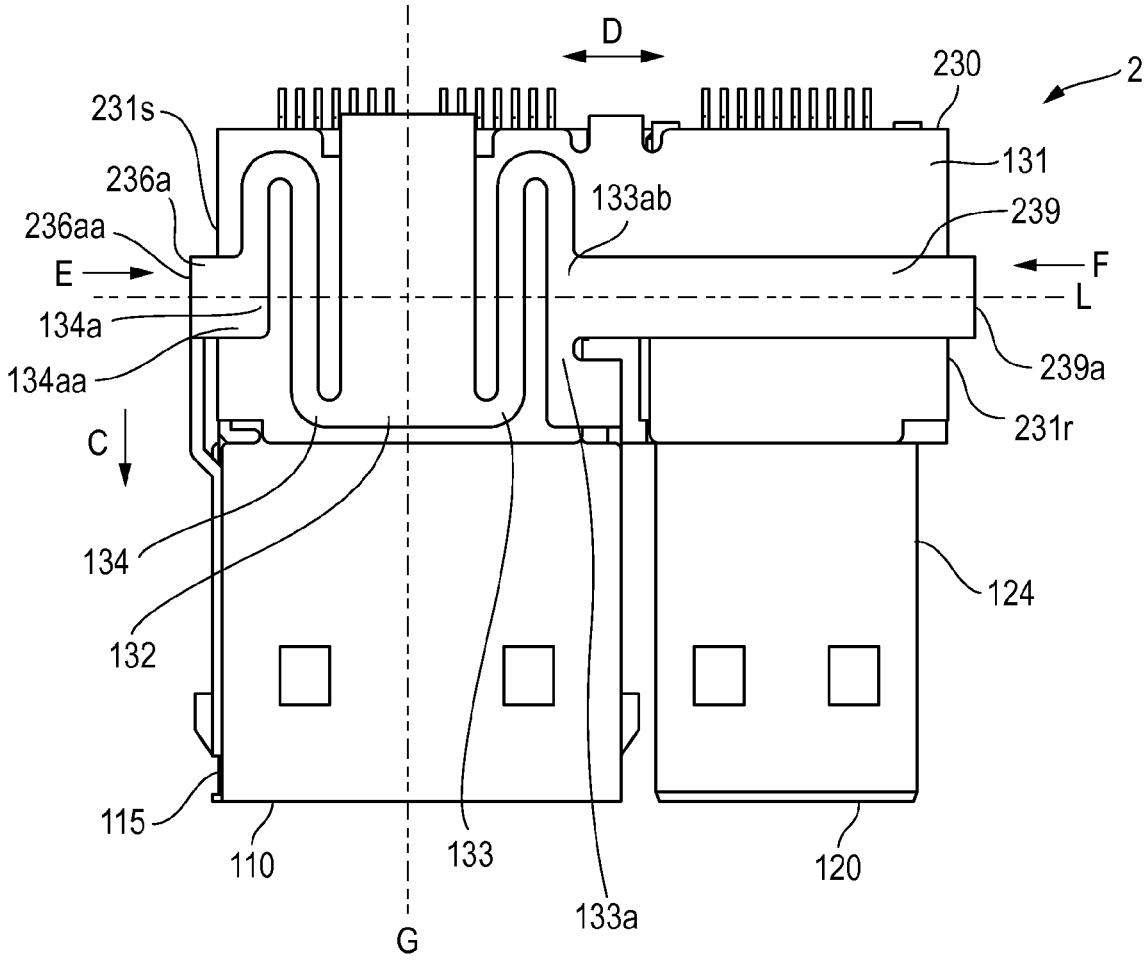
FIG. 15 is a plan view of a locking connector of a second embodiment.

In a locking connector 2 of a second embodiment illustrated in FIG. 15, a second arm base end part 236*a* extending along the base 131 from a fore-end 134*aa* of the other end 134*a* of a second resilient part 134 to the outside of the side surface 115 (second side surface) of a first head part 110, a second pressing part 236*aa* formed at the second arm base end part 236*a*, an extended arm part 239 extending along a top surface (plate surface) from the central part 133*ab* of the other end 133*a* of a first resilient part 133 and positioned outside of a side surface 124 of a second head part 120, and a first pressing part 239*a* formed at a fore-end of the extended arm part 239 are positioned on a plane L perpendicular to the direction C. The second arm base end part 236*a* is the part extending along the base 131 from the fore-end 134*aa* to the outside of the edge 231*s* of the base 131. The edge 231*s* is positioned along the side surface 115. That is, one end of the second arm base end part 236*a* is supported by the fore-end 134*aa*; the other end of the second arm base end part 236*a* is located at the outside of the side surface 115. The extended arm part 239 is the part extending along the base 131 from the other end 133*a* to the outside of the edge 231*r* of the base 131. The edge 231*r* is positioned along the side surface 124. That is, one end of the extended arm part 239 is supported by the other end 133*a*; the other end of the extended arm part 239 is located at the outside of the side surface 124. With this configuration, highly symmetric pressing forces are applied to the first resilient part 133 and the second resilient part 134, and accordingly a higher latching reliability is achieved. The other components of the locking connector 2 are the same as those of the locking connector 1 described in the first embodiment. The components in the second embodiment (FIG. 15) that are the same as those described in the first embodiment are given the reference numerals used in the first embodiment.

Third Embodiment

Figure 16:
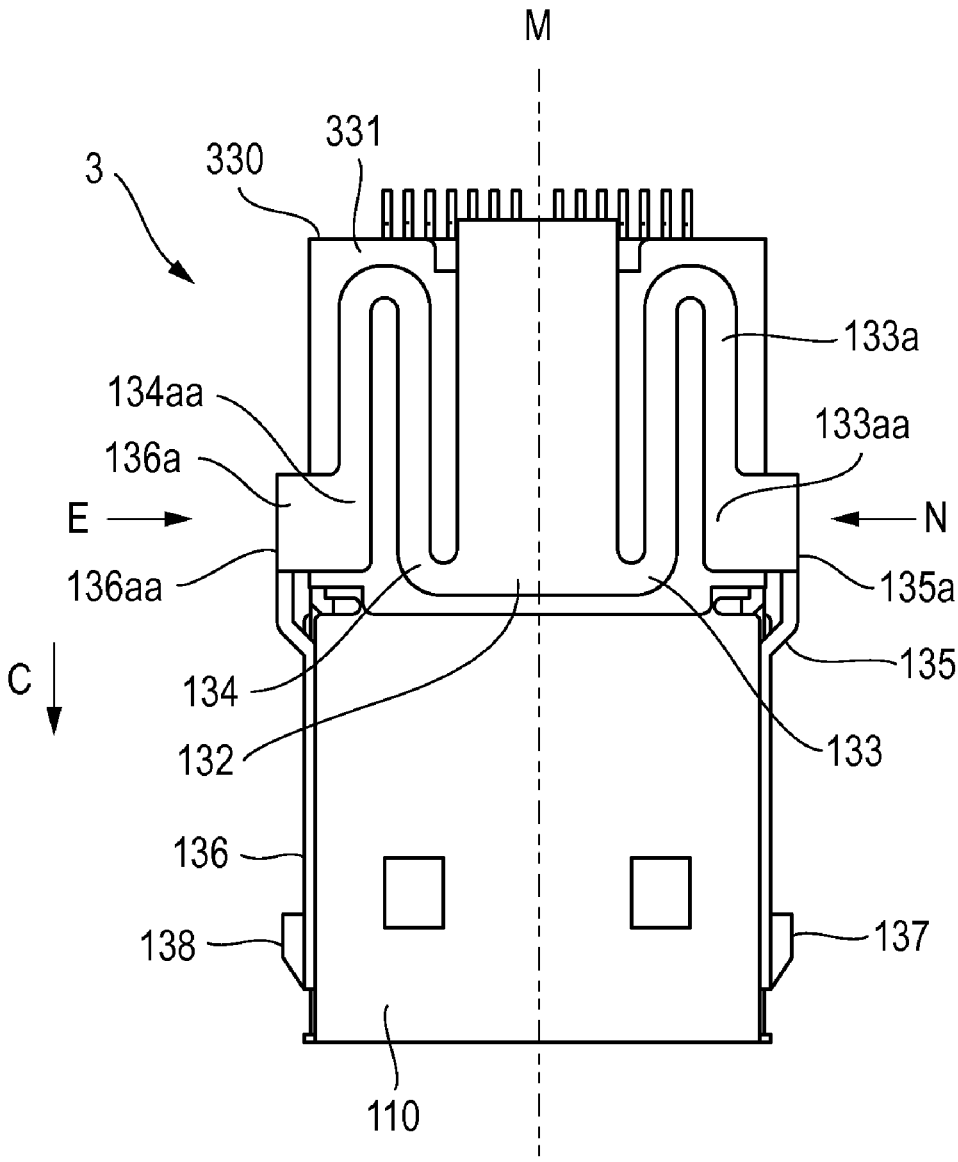
FIG. 16 is a plan view of a locking connector of a third embodiment.

A locking connector 3 of a third embodiment illustrated in FIG. 16 does not include the second head part 120. A cover 330 is fixed only to the first head part 110. The first resilient part 133 and the second resilient part 134 may be symmetrical with respect to a plane M that is parallel to the direction C and orthogonal to the supporting part 132, a first arm base end part 335*a* and the second arm base end part 136*a* may be symmetrical, the first arm part 135 and the second arm part 136 may be symmetrical, and the first latching part 137 and the second latching part 138 may be symmetrical. With this configuration, a highly symmetric pressing force is exerted on the first resilient part 133 and the second resilient part 134, and accordingly a higher latching reliability is achieved. The other components of the locking connector 3 are the same as those of the locking connector 1 described in the first embodiment. The components in the third embodiment (FIG. 16) that are the same as those described in the first embodiment are given the reference numerals used in the first embodiment.

Fourth Embodiment

Figure 17:
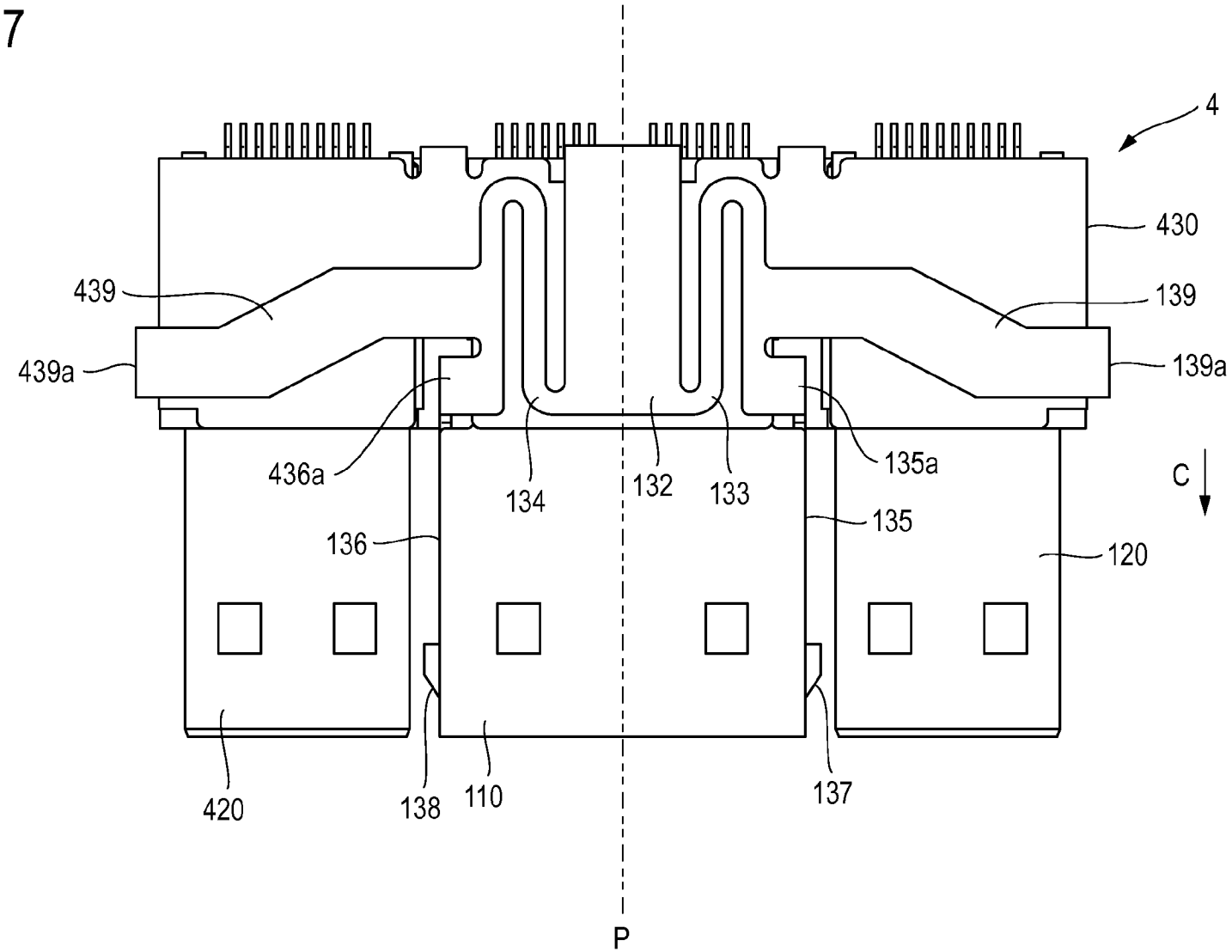
FIG. 17 is a plan view of a locking connector of a fourth embodiment.

A locking connector 4 illustrated in FIG. 17 includes a first head part 110, a second head part 120 and a third head part 420. The second head part 120 and the third head part 420 are positioned on either side of the first head part 110. The fore-ends of the first head part 110, the second head part 120, and the third head part 420 face in the direction C. The locking connector 4 may be symmetrical with respect to a plane P that is parallel to the direction C and orthogonal to the supporting part 132. For example, the first resilient part 133 and the second resilient part 134 may be symmetrical with the plane P, the first arm base end part 135*a* and a second arm base end part 436*a* may be symmetrical, the first arm part 135 and the second arm part 136 may be symmetrical, the first latching part 137 and the second latching part 138 may be symmetrical, the extended arm part 139 and the extended arm part 439 are symmetrical, and the first pressing part 139*a* and a second pressing part 439*a* may be symmetrical. In that case, the symmetry of the forces exerted on the first resilient part 133 and the second resilient part 134 is improved and therefore a higher latching reliability is achieved. The other components of the locking connector 4 are the same as those of the locking connector 1 described in the first embodiment. The components in the fourth embodiment (FIG. 17) that are the same as those described in the first embodiment are given the reference numerals used in the first embodiment.

Other Variations

The present invention is not limited to the embodiments described above. Many modifications and variations of the present invention will be apparent to those skilled in the art. For example, the present invention can be applied to a multi-plug connector having four or more head. Instead of folding the edge of the base 131 on the base-end 111 side, the edge of the base 131 may be folded on the fore-end 112 side to form a supporting part. While the components such as supporting part, the resilient parts, the arm base end parts, and the extended arm parts are not in contact with the base, except the folded part in the above-described embodiments, at least some of these components may be in contact with the base. The accompanying claims should be interpreted in the broadest sense in light of common general technical knowledge including many such modifications and variations.

What is claimed is:

1. A locking connector comprising:

a first head part which is a flat connector head having a mating part formed at a fore-end;

a plate-like base covering a plate surface of the first head part, the plate surface located along a direction from a base end of the first head part to the fore-end of the first head part;

a supporting part positioned along a plate surface of the base, one end of the supporting part being supported by the base;

a first resilient part positioned along the plate surface of the base, one end of the first resilient part being supported by the supporting part, the first resilient part being resiliently deformable in a first direction along the plate surface of the base, the first direction being perpendicular to the direction from the base end toward the fore-end, the other end of the first resilient part being movable along the first direction;

a first arm base end part extending along the base from the other end of the first resilient part to an outside of a first edge of the base, the first edge located along a first side surface of the first head part;

a first arm part extending along the first side surface of the first head part from the first arm base end part in the direction from the base end toward the fore-end, the first arm part being positioned apart from the base and the first head part;

a first latching part formed on the first arm part, the first latching part being a protrusion protruding outwardly away from the first side surface;

a second resilient part positioned along the plate surface of the base, one end of the second resilient part being supported by the supporting part, the second resilient part being resiliently deformable in a second direction along the plate surface of the base, the second direction being perpendicular to the direction from the base end toward the fore-end, the other end of the second resilient part being movable along the second direction;

a second arm base end part extending along the base from the other end of the second resilient part to an outside of a second edge of the base, the second edge located along a second side surface of the first head part;

a second arm part extending along the second side surface of the first head part from the second arm base end part in the direction from the base end toward the fore-end, the second arm part being positioned apart from the base and the first head part; and a second latching part formed on the second arm part, the second latching part being a protrusion protruding outwardly away from the second side surface;

wherein the supporting part is positioned between the first resilient part and the second resilient part, and the first head part is positioned between the first arm part and the second arm part.

2. The locking connector according to claim 1, wherein:

the other end of the first resilient part moves in the direction perpendicular to the direction from the base end toward the fore-end as the first resilient part resiliently deforms in the first direction, and the other end of the second resilient part moves in the direction perpendicular to the direction from the base end toward the fore-end as the second resilient part resiliently deforms in the second direction.

3. The locking connector according to claim 1, wherein:

the first resilient part includes a first resiliently deformable part formed into a strip meandering from the supporting part toward the first side surface; and the second resilient part includes a second resiliently deformable part formed into a strip meandering from the supporting part toward the second side surface.

4. The locking connector according to claim 3, wherein:

the other end of the first resilient part moves in the direction perpendicular to the direction from the base end toward the fore-end as the first resilient part resiliently deforms in the first direction, and the other end of the second resilient part moves in the direction perpendicular to the direction from the base end toward the fore-end as the second resilient part resiliently deforms in the second direction.

5. The locking connector according to claim 3, wherein:

the first resiliently deformable part and the second resiliently deformable part are symmetrical with respect to a plane along the direction from the base end toward the fore-end.

6. The locking connector according to claim 3, wherein:

the base includes an edge located on the base end side of the first head part and the edge is folded in the direction from the base end toward the fore-end; and the supporting part is a cantilever plate formed along the plate surface of the base from the folded edge in the direction from the base end toward the fore-end.

7. The locking connector according to claim 1, wherein:

the first resilient part includes a first resiliently deformable part which is a U-shaped strip, one end of the U-shaped strip being supported by the supporting part; and the second resilient part includes a second resiliently deformable part which is a U-shaped strip, one end of the U-shaped strip being supported by the supporting part.

8. The locking connector according to claim 7, wherein:

the other end of the first resilient part moves in the direction perpendicular to the direction from the base end toward the fore-end as the first resilient part resiliently deforms in the first direction, and the other end of the second resilient part moves in the direction perpendicular to the direction from the base end toward the fore-end as the second resilient part resiliently deforms in the second direction.

9. The locking connector according to claim 7, wherein:

the first resiliently deformable part and the second resiliently deformable part are symmetrical with respect to a plane along the direction from the base end toward the fore-end.

10. The locking connector according to claim 7, wherein:

the base includes an edge located on the base end side of the first head part and the edge is folded in the direction from the base end toward the fore-end; and the supporting part is a cantilever plate formed along the plate surface of the base from the folded edge in the direction from the base end toward the fore-end.

11. The locking connector according to claim 1, wherein:

the first resilient part includes a first resiliently deformable part which resiliently deforms when pressed along the first direction;

the second resilient part includes a second resiliently deformable part which resiliently deforms when pressed along the second direction; and the first resiliently deformable part and the second resiliently deformable part are symmetrical with respect to a plane along the direction from the base end toward the fore-end.

12. The locking connector according to claim 1, further comprising a second head part which is a flat connector head having a mating part formed at a fore-end, the fore-end of the second head part facing the direction from the base end toward the fore-end.

13. The locking connector according to claim 12, wherein:

the first head part and the second head part are positioned side by side and spaced apart from each other, the plate surface of the first head part and a plate surface of the second head part face the same direction, the first resilient part is positioned on the second head part side of the supporting part, the first side surface faces the second head part, and the first arm part is positioned between the first head part and the second head part;

the locking connector further comprising:

an extended arm part extending along the plate surface of the second head part from the other end of the first resilient part to an outside of a third edge of the base, the third edge located along a side surface of the second head part, the side surface of the second head part positioned along the direction from the base end toward the fore-end; and a first pressing part formed in a portion of the extended arm part, the portion being positioned outside the side surface of the second head part.

14. The locking connector according to claim 13, further comprising a second pressing part formed at the second arm base end part, wherein the first pressing part and the second pressing part intersect with a plane facing the direction from the base end toward the fore-end.

15. The locking connector according to claim 1, wherein the base includes an edge located on the base end side of the first head part and the edge is folded in the direction from the base end toward the fore-end; and the supporting part is a cantilever plate formed along the plate surface of the base from the folded edge in the direction from the base end toward the fore-end.

16. The locking connector according to claim 15, wherein the base, the supporting part, the first and second resilient parts, the first and second arm base end parts, the first and second arm parts, and the first and second latching parts are one integral structure.

17. The locking connector according to claim 1, wherein:

the first head part is a head part of a plug connector and the surface opposite from the plate surface of the first head part is a mounting surface of the first head part, the mounting surface being located along the plate surface of the first head part.

18. An electronic apparatus comprising a locking connector, the locking connector comprising:

a first head part which is a flat connector head having a mating part formed at a fore-end;

a plate-like base covering a plate surface of the first head part, the plate surface located along a direction from a base end of the first head part to the fore-end of the first head part;

a supporting part positioned along a plate surface of the base, one end of the supporting part being supported by the base;

a first resilient part positioned along the plate surface of the base, one end of the first resilient part being supported by the supporting part, the first resilient part being resiliently deformable in a first direction along the plate surface of the base, the first direction being perpendicular to the direction from the base end toward the fore-end, the other end of the first resilient part being movable along the first direction;

a first arm base end part extending along the base from the other end of the first resilient part to an outside of a first edge of the base, the first edge located along a first side surface of the first head part;

a first arm part extending along the first side surface of the first head part from the first arm base end part in the direction from the base end toward the fore-end, the first arm part being positioned apart from the base and the first head part;

a first latching part formed on the first arm part, the first latching part being a protrusion protruding outwardly away from the first side surface;

a second resilient part positioned along the plate surface of the base, one end of the second resilient part being supported by the supporting part, the second resilient part being resiliently deformable in a second direction along the plate surface of the base, the second direction being perpendicular to the direction from the base end toward the fore-end, the other end of the second resilient part being movable along the second direction;

a second arm base end part extending along the base from the other end of the second resilient part to an outside of a second edge of the base, the second edge located along a second side surface of the first head part;

a second arm part extending along the second side surface of the first head part from the second arm base end part in the direction from the base end toward the fore-end, the second arm part being positioned apart from the base and the first head part; and a second latching part formed on the second arm part, the second latching part being a protrusion protruding outwardly away from the second side surface;

wherein the supporting part is positioned between the first resilient part and the second resilient part, and the first head part is positioned between the first arm part and the second arm part.

19. The electronic apparatus according to claim 18, wherein:

the other end of the first resilient part moves in the direction perpendicular to the direction from the base end toward the fore-end as the first resilient part resiliently deforms in the first direction, and the other end of the second resilient part moves in the direction perpendicular to the direction from the base end toward the fore-end as the second resilient part resiliently deforms in the second direction.

20. The electronic apparatus according to claim 18, wherein:

the first resilient part includes a first resiliently deformable part formed into a strip meandering from the supporting part toward the first side surface; and the second resilient part includes a second resiliently deformable part formed into a strip meandering from the supporting part toward the second side surface.

* * * * *